US012274907B2

(12) United States Patent
Wallander

(10) Patent No.: US 12,274,907 B2
(45) Date of Patent: Apr. 15, 2025

(54) RETRACTION DEVICE HAVING MULTIPLE CABLES

(71) Applicant: William Wallander, Dallas, TX (US)

(72) Inventor: William Wallander, Dallas, TX (US)

(73) Assignee: Nuvalux LLC, Dallas, TX (US)

( * ) Notice: Subject to any disclaimer, the term of this patent is extended or adjusted under 35 U.S.C. 154(b) by 0 days.

(21) Appl. No.: 18/142,095

(22) Filed: May 2, 2023

(65) Prior Publication Data

US 2024/0165455 A1 May 23, 2024

Related U.S. Application Data

(63) Continuation of application No. PCT/US2023/019732, filed on Apr. 25, 2023, which is a continuation of application No. 17/988,926, filed on Nov. 17, 2022.

(60) Provisional application No. 63/480,700, filed on Jan. 20, 2023.

(51) Int. Cl.

| | |
|---|---|
| ***A63B 21/00*** | (2006.01) |
| ***A63B 21/16*** | (2006.01) |
| ***A63B 24/00*** | (2006.01) |

(52) U.S. Cl.

CPC ..... *A63B 21/153* (2013.01); *A63B 21/00061* (2013.01); *A63B 21/16* (2013.01); *A63B 24/0062* (2013.01); *A63B 2220/833* (2013.01); *A63B 2225/15* (2013.01); *A63B 2225/50* (2013.01)

(58) Field of Classification Search

CPC ..... A63B 21/151; A63B 21/153; A63B 21/00069

See application file for complete search history.

(56) References Cited

U.S. PATENT DOCUMENTS

| | | | | |
|---|---|---|---|---|
| 6,149,559 | A | 11/2000 | Mackey | |
| 2010/0197462 | A1* | 8/2010 | Piane, Jr. | A63B 21/00 482/8 |
| 2011/0287910 | A1 | 11/2011 | Ladd et al. | |
| 2015/0011368 | A1 | 1/2015 | Manor et al. | |
| 2015/0024911 | A1 | 1/2015 | Ross | |
| 2019/0344123 | A1* | 11/2019 | Rubin | A63B 21/0058 |
| 2021/0128978 | A1* | 5/2021 | Gilstrom | A63B 24/0087 |
| 2021/0128979 | A1* | 5/2021 | McHugh | G06F 1/163 |
| 2021/0339078 | A1 | 11/2021 | Akeel et al. | |

FOREIGN PATENT DOCUMENTS

CN 216755290 U 6/2022

OTHER PUBLICATIONS

Korean Patent Office, International Search Report issued in PCT/US2023/0189731, Aug. 21, 2023, 5 pages.

Korean Patent Office, Written Opinion issued in PCT/US2023/0189731, Aug. 21, 2023, 13 pages.

https://www.tonal.com/

* cited by examiner

*Primary Examiner* — Zachary T Moore

(74) *Attorney, Agent, or Firm* — Barnes & Thornburg LLP; Jerry C. Harris, Jr.

(57) ABSTRACT

An exercise device includes a housing. A first cable is configured to extend from the housing between a retracted position and an extended position. A second cable is configured to extend from the housing between a retracted position and an extended position. The first cable and the second cable independently move between the extended position and the retracted position.

10 Claims, 26 Drawing Sheets

RETRACTION DEVICE HAVING MULTIPLE CABLES

CROSS-REFERENCE TO RELATED APPLICATIONS

This application is a continuation application of, and claims priority to, PCT Patent Application No. PCT/US2023/019732 filed on Apr. 25, 2023, which claims priority to U.S. patent application Ser. No. 17/988,926, filed Nov. 17, 2022, and U.S. Patent Application Ser. No. 63/480,700, filed Jan. 20, 2023, each of which are hereby expressly incorporated herein.

BACKGROUND

Providing a full body exercise, medical rehabilitation, and sports training and recovery often require various pieces of equipment. It can also be desired to alter a weight or resistance of the equipment. Accordingly, many are challenged to obtain a time efficient exercise or rehabilitation regimen and often struggle to complete their regimen while at home, traveling or when a gym and other workout equipment is not accessible. Additionally, many forms of physical therapy and sports training can require the use of exercises for stretching and lifting with varying levels of resistance and energy transfer via movement. A need exists for a portable device that enables both focused and full body exercise at variable levels of resistance and energy transfer via movement and use at any location. Further, such a device can be utilized to provide various levels of resistance, pull, and lifting which will have commercial applications including moving materials, and to provide a component for use in other applications or equipment including robotics that can use a retraction device with the properties included in this application.

SUMMARY

The present disclosure includes one or more of the features recited in the appended claims and/or the following features which, alone or in any combination, may comprise patentable subject matter.

According to a first aspect of the disclosed embodiments, a retraction apparatus includes an anchor or connection device configured to attach to at least one of a user, a fixed location, or an item or object part of the work process. A housing is coupled to the anchor or connection device. A retractable cable extends from the housing and is configured to move between a retracted position and an extended position. An attachment mechanism is configured to couple to a free end of the retractable cable. A tensioning mechanism is configured to provide resistance to movement of the retractable cable from the retracted position to the extended position.

In some embodiments of the first aspect, the retractable cable can be connected to a resistance device. The tensioning mechanism can restrict movement of the resistance device. The tensioning mechanism can include at least one of a spring, a magnet, a weight, an electronic resistance device, a motor, and an elastic cable. A sensor can be configured to detect properties of the retractable cable as the retractable cable moves between the retracted position and the extended position. The sensor can include at least one RFID tag attached to the retractable cable. An RFID reader can be positioned in the housing and configured to detect the at least one RFID tag. The sensor can measure at least one of a number of extensions, a time of use, a speed, a velocity, an acceleration, a length, a weight, work and energy transfer, a vector, or a direction of the retractable cable. A display can be configured to display the properties of the retractable cable. A wireless transceiver can be provided to transfer data related to movement of the retractable cable to a remote device. A power generator can generate an electrical current when the retractable cable moves in either direction between the retracted position and the extended position.

According to a second aspect of the disclosed embodiments, a retraction apparatus includes an anchor device configured to attach to at least one of a user or a fixed location. A housing is coupled to the anchor device. A plurality of retractable cables extend from the housing and are configured to move between a retracted position and an extended position. Each of the plurality of retractable cables is tensioned to restrict movement of the plurality of retractable cable from the retracted position to the extended position. An attachment mechanism configured to couple to a free end of at least one of the retractable cables.

In some embodiments of the second aspect, the attachment mechanism can be configured to couple different combinations of the plurality of retractable cables to vary a tension of the apparatus. Each of the plurality of retractable cables can be identified with a different indicia. A plurality of resistance devices can be provided. Each of the plurality retractable cables can be connected to one of the plurality of resistance devices. A plurality of tensioning mechanisms can be provided. Each of the plurality of tensioning mechanisms can be configured to restrict movement of one of the plurality of retractable cables. A sensor can be configured to detect properties of the plurality of retractable cables as the plurality of retractable cables move between the retracted position and the extended position. Each of the plurality of retractable cables can be differently tensioned. A wireless transceiver can be provided to transfer data related to movement of the retractable cable to a remote device. A power generator can generate an electrical current when at least one of the plurality of retractable cables moves in either direction between the retracted position and the extended position.

According to a third aspect of the disclosed embodiments, a retraction apparatus includes an anchor device configured to attach to at least one of a user or a fixed location. A housing is coupled to the anchor device. A retractable cable extends from the housing and is configured to move between a retracted position and an extended position. An attachment mechanism is configured to couple to a free end of the retractable cable. A sensor is configured to detect properties of the retractable cable as the retractable cable moves between the retracted position and the extended position.

In some embodiments of the third aspect, the sensor can include at least one RFID tag attached to the retractable cable. An RFID reader can be positioned in the housing and can be configured to detect the at least one RFID tag. The sensor can measure at least one of a number of extensions, a time of use, a speed, a velocity, an acceleration, a length, a weight, work and energy transfer, a vector, or a direction of the retractable cable. A display can be provided to display the properties of the retractable cable as measured by the sensor. A plurality of retractable cables can extend from the housing and can be configured to move between a retracted position and an extended position. Each of the plurality of retractable cables can be differently tensioned. A wireless transceiver can be provided to transfer data related to movement of the retractable cable to a remote device. A power generator can generate an electrical current when the retractable cable moves in either direction between the retracted position and the extended position.

According to a fourth aspect of the disclosed embodiments, a retraction apparatus includes an anchor device configured to attach to at least one of a user or a fixed location. A housing is coupled to the anchor device. A retractable cable extends from the housing and is configured to move between a retracted position and an extended position. A plurality of interchangeable attachment mechanisms are configured to attach to a free end of the retractable cable.

In some embodiments of the fourth aspect, at least one of the plurality of interchangeable attachment mechanisms can be coupleable to a limb of the user. At least one of the plurality of interchangeable attachment mechanisms can be usable to perform an exercise. A power generator can generate an electrical current when the retractable cable moves in either direction between the retracted position and the extended position.

According to a fifth aspect of the disclosed embodiments, a power generation device includes a housing. A cable is configured to extend from the housing between a retracted position and an extended position. A resistance device positioned in the housing and configured to bias the cable into the retracted position. A magnet is positioned in the housing. A coil of wire is positioned within the housing adjacent the magnet. Movement of the cable between the retracted position and the extended position causes at least one of the magnet and the coil to move relative to the other of the magnet and the coil to generate an electric current.

In some embodiments of the fifth aspect, the magnet can rotate relative to the coil. The coil can rotate relative to the magnet. The magnet can rotate in a first direction and the coil can rotate in a second direction opposite the first direction. An axle can extend through the housing. The resistance device can be coupled to the axle so that the axle rotates when the cable moves between the retracted position and the extended position. The magnet can be coupled to the axle so that the magnet rotates when the cable moves between the retracted position and the extended position. The coil can be coupled to the housing and positioned around the magnet. The coil can be coupled to the axle so that the coil rotates when the cable moves between the retracted position and the extended position. The magnet can be coupled to the housing and positioned around the coil. The axle can include a first axle and a second axle. The first axle can rotate in a first axial direction and the second axle can rotate in a second axial direction that is opposite the first axial direction. The coil can be coupled to the first axle and the magnet can be coupled to the second axle. A clutch can couple the resistance device to the first axle to rotate the first axle in the first axial direction when the cable is moved from the retracted position to the extended position. The clutch can couple the resistance device to the second axle to rotate the second axle when the resistance device moves the cable from the extended position to the retracted position. A first cable can be coupled to a first resistance device. Movement of the first cable between the retracted position and the extended position can cause the magnet to move relative to the coil. A second cable can be coupled a second resistance device. Movement of the second cable between the retracted positioned and the extended position can cause the coil to move relative to the magnet. The magnet can move in a first direction and the coil can move in a second direction that is opposite the first direction. The cable can have a length that is greater than a reach of a user. The device can be an exercise device. The electric current can be stored in a battery. The electric current can power a facility housing the exercise device.

According to a sixth aspect of the disclosed embodiments, a portable device for generating power includes a portable housing. A cable is configured to extend from the portable housing between a retracted position and an extended position. A resistance device is positioned in the portable housing and is configured to bias the cable into the retracted position. A magnet is positioned in the housing. A coil of wire is positioned within the housing adjacent the magnet. Movement of the cable between the retracted position and the extended position causes at least one of the magnet and the coil to move relative to the other of the magnet and the coil to generate an electric current. A rechargeable battery is configured to electrically couple to the portable housing to store the electric current.

According to a seventh aspect of the disclosed embodiments, a power generation device for a health facility includes a housing that is configured to position in an exercise device of the health facility. A cable is configured to extend from the housing between a retracted position and an extended position. A resistance device is positioned in the housing and is configured to bias the cable into the retracted position. A magnet is positioned in the housing. A coil of wire is positioned within the housing adjacent the magnet. Movement of the cable between the retracted position and the extended position causes at least one of the magnet and the coil to move relative to the other of the magnet and the coil to generate an electric current. An electrical connection is provided between the housing and an electrical supply of the health facility so that the electric current is transmitted to the electrical supply of the health facility.

According to an eighth aspect of the disclosed embodiments, an exercise device includes a housing. A first cable is configured to extend from the housing between a retracted position and an extended position. A first resistance device is positioned in the housing and configured to bias the first cable into the retracted position. A second cable is configured to extend from the housing between a retracted position and an extended position. A second resistance device is positioned in the housing and configured to bias the second cable into the retracted position. The first cable and the second cable independently move between the extended position and the retracted position.

Optionally, in the eighth aspect, the housing can be configured to couple to a fixed location to anchor the device. The housing can be configured to secure to a user. Each of the first cable and the second cable can have a length that is greater than a reach of a user. Each of the first cable and the second cable can be configured to be secured to separate limbs of the user so that the first cable and the second cable are moved through the movement of each respective limb. Each of the first cable and the second cable can be configured to secure to the same limb of a user to increase a resistance of the device. A resistance of each of the first cable and the second cable can be configured to be independently altered. The first cable can be configured to move in a first direction. The second cable can be configured to move in a second direction. The first direction can be independent of the second direction. Movement of at least one of the first cable and the second cable can generate an electric current. The housing can include a first housing and a second housing. The first resistance device can be positioned in the first housing and the first cable can extend from and retract into the first housing. The second resistance device can be positioned in the second housing and the second cable can extend from and retract into the second housing. The first housing can be configured to couple to the second housing with a fastener. Each of the first housing and the second housing can include a control system. The control system of at least one of the first housing and the second housing can track data related to movement of the first cable and the second cable. The control systems of the first housing and the second housing can wirelessly communicate. At least one of the first housing and the second housing can include a power generation device to generate an electric current when the respective cable moves between the retracted and extended position.

According to a ninth aspect of the disclosed embodiments, an exercise device includes a housing. A plurality of cables are configured to extend from the housing between a retracted position and an extended position. A plurality of resistance devices are positioned in the housing and are configured to bias the respective cable into the retracted position. A control system tracks data related to movement of the plurality of cables. Each of the plurality of cables independently move between the extended position and the retracted position. It may be desired, in the ninth aspect, that a power generation device can generate an electric current when at least one of the plurality of cables moves between the retracted and extended position.

According to a tenth aspect of the disclosed embodiments, an exercise kit includes a plurality of devices. Each device includes a cable configured to extend from a housing between a retracted position and an extended position. A resistance device is positioned in the housing and is configured to bias the cable into the retracted position. A control system tracks data related to movement of the cable. The control systems of each device communicate wirelessly.

It may be contemplated, in the tenth aspect, that the plurality of devices can include a master device and at least one slave device. The master device can store the data tracked by the master device and the at least one slave device. At least one of the plurality of devices can include a power generation device to generate an electric current when the respective cable moves between the retracted and extended position. Each of the plurality of devices can be configured to fasten to at least one other of the plurality of devices.

According to an eleventh aspect of the disclosed embodiments, an exercise device includes a cable configured to extend from a housing between a retracted position and an extended position. A resistance device is positioned in the housing and configured to bias the cable into the retracted position. A tensioning mechanism is formed integrally with the housing and has a compression device to restrict movement of the cable. The tensioning mechanism extends from a first end and a second end. Each of the first end and the second end are formed integrally with the housing.

In some embodiments of the eleventh aspect, the tensioning mechanism can include a tensioning disk positioned at a first end of the compression device. A moving disk can be positioned at a second end of the compression device. Movement of the tensioning disk can cause the compression device to compress on the moving disk, thereby restricting movement of the moving disk. The cable can be coupled to at least one of the compression device and the moving disk. A movement bolt can be provided. Actuation of the tensioning disk can rotate the movement bolt to compress the compression device. The compression device can include a spring. A plurality of cables and a plurality of compression devices can be provided. Each of the plurality of compression devices can restrict the movement of one of the plurality of cables. A plurality of tensioning disks can be provided. Each of the plurality of tensioning disks can actuate one of the plurality of compression devices.

According to a twelfth aspect of the disclosed embodiments, an exercise device includes a cable configured to extend from a housing between a retracted position and an extended position. A resistance device is configured to bias the cable into the retracted position. A tensioning mechanism includes a compression device to restrict movement of the cable. The tensioning mechanism also includes a tensioning disk that is actuated from outside the housing to compress the compression device. A moving disk is compressed by the compression device to restrict movement of the moving disk.

Optionally, in the twelfth aspect, the cable can be coupled to at least one of the compression device and the moving disk. A movement bolt can be provided. Actuation of the tensioning disk can rotate the movement bolt to compress the compression device. The compression device can include a spring. The compression device can include a compressible foam.

According to a thirteenth aspect of the disclosed embodiments, an exercise device includes a first cable configured to extend from a housing between a retracted position and an extended position. A second cable is configured to extend from a housing between a retracted position and an extended position. A tensioning mechanism is configured to independently restrict movement of the first cable and the second cable. The tensioning mechanism includes a first compression device and a first tensioning disk to compress the first compression device. The tensioning mechanism also includes a second compression device and a second tensioning disk to compress the first compression device.

It may be desired, in the thirteenth aspect, that a first moving disk can be compressed by the first compression device to restrict movement of the first moving disk. A second moving disk can be compressed by the second compression device to restrict movement of the second moving disk. Each cable can be coupled to at least one of the respective compression device and the respective moving disk. A first movement bolt can be provided. Actuation of the first tensioning disk can rotate the first movement bolt to compress the first compression device. A second movement bolt can be provided. Actuation of the second tensioning disk can rotate the second movement bolt to compress the second compression device. At least one of the first compression device and the second compression device can include a spring. At least one of the first compression device and the second compression device can include a compressible foam.

According to a fourteenth aspect of the disclosed embodiments, an exercise kit includes a casing defining a cavity. A plurality of exercise devices is configured to position in the cavity of the casing. Each of the plurality of exercise devices includes cable that is configured to extend from the exercise device between a retracted position and an extended position. A resistance device is positioned in the exercise device and is configured to bias the cable into the retracted position. The cable of each of the plurality of exercise devices is tensioned to restrict movement of the cable between the retracted position and the extended position.

In some embodiments of the fourteenth aspect, each of the plurality of exercise devices can include a tensioning mechanism to tension the respective cable. The tensioning mechanism can be adjustable to alter the tension on the cable. Each cable of each of the plurality of exercise devices can have a different degree of tension. Any combination of the plurality of exercise devices can be positionable in the cavity of the casing. The cable of each of the plurality of exercise devices can extend from the casing when the exercise device is positioned in the cavity of the casing. The casing can include an opening through which the cable of each of the plurality of exercise devices extends when the exercise device is positioned in the cavity of the casing. An end of each cable extending from the casing can be coupleable to an interchangeable exercise component. The interchangeable exercise component can include at least one of a bar, a loop, and a cuff. The cavity of the casing can include a plurality of slots. Each of the plurality of exercise devices can be positionable in one of the plurality of slots.

According to a fifteenth aspect of the disclosed embodiments, an exercise kit includes a casing defining a cavity. A plurality of exercise devices is configured to position in the cavity of the casing. Each of the plurality of exercise devices includes a cable that is configured to extend from the exercise device between a retracted position and an extended position. A resistance device is positioned in the exercise device and configured to bias the cable into the retracted position. The cable of each of the plurality of exercise devices is coupleable to an interchangeable exercise component.

Optionally, in the fifteenth aspect, each of the plurality of exercise devices can include a tensioning mechanism to restrict movement of the cable between the retracted position and the extended position. The tensioning mechanism can be adjustable to alter the tension on the cable. Each cable of each of the plurality of exercise devices can have a different degree of tension. The plurality of exercise devices can be interchangeable in the casing to alter a total tension when extending and retracting the interchangeable exercise component. Any combination of the plurality of exercise devices can be positionable in the cavity of the casing. The cable of each of the plurality of exercise devices can extend from the casing when the exercise device is positioned in the cavity of the casing. Each of the plurality of exercise devices can include an opening through which the respective cable extends. A protective component can be positioned adjacent the opening and configured to guide the cable through the opening. The interchangeable exercise component can include at least one of a bar, a loop, and a cuff. The cavity of the casing can include a plurality of slots. Each of the plurality of exercise devices can be positionable in one of the plurality of slots.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
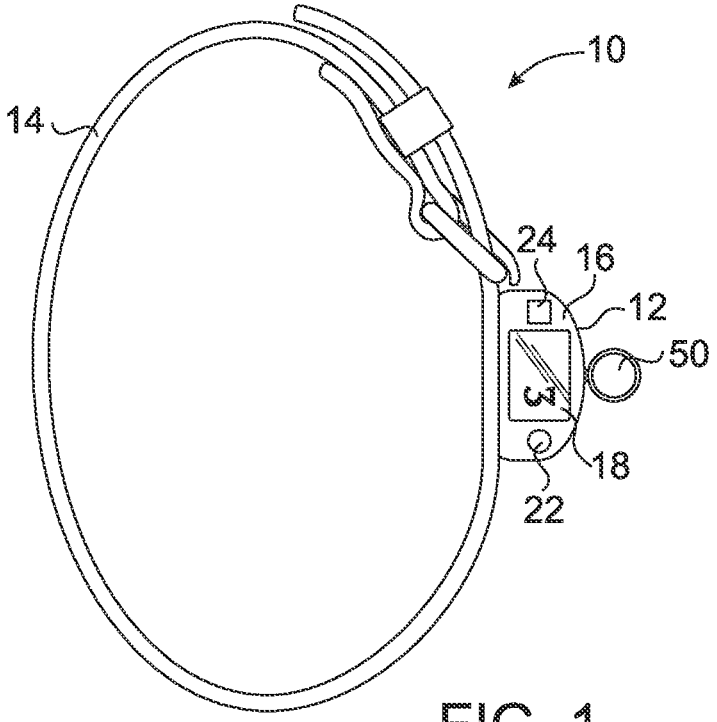
FIG. 1 is a top view of a retraction device having an anchor device and a retractable cable extending from the anchor device, wherein the retractable cable is in a retracted position.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Unless defined otherwise, technical and scientific terms used herein have the same meaning as commonly understood by one of ordinary skill in the art to which the claimed material belongs. The following terms are defined below.

"coupleable" in this context refers to being able to be mechanically joined via force(s) generated by adhesion, cohesion, friction, fastening, magnetism, tension, etc.

"fastener" in this context refers to a hardware device that mechanically joins or affixes two or more objects together, generally used to create non-permanent joints (e.g., releasable or lockable), including anchor bolts, battens, bolts (including screws), brass fasteners, buckles, buttons, cable ties, captive fasteners, clamps (or cramps, including hose clamps), clasps (including lobster clasps), clekos, clips (including circlips, hairpin clips, paper clips, and terry clips), clutches, drawing pins (thumbtack), flanges, frogs, grommets, hook-and-eye closures, hook and loop fasteners (including Velcro), latches, nails, pegs (including clothespins and tent pegs), PEM nuts, pins (including bowtie cotter pins, circle cotters, clevis fasteners, cotters, dowels, linchpins, R-clips, split pins, spring pins, and tapered pins), retaining rings (including circlips and e-rings), rivets, rock bolts, rubber bands (or bands of other materials), screw anchors, snap fasteners, staples, stitches, straps, threaded fasteners (including captive threaded fasteners, nuts, screws, washers, threaded inserts, and threaded axles), ties, toggle bolts, treasury tags, twist ties, wedge anchors, and zippers.

Referring now to FIG. 1, a retraction device 10 is configured for use as an exercise device or a device that assists in the movement of a load. The retraction device 10 includes an anchor device 12 that is coupleable to a user or a fixed location, for example, a workout mat. For example, in some embodiments, the anchor device 12 is coupleable to a user's waist. In other embodiments, the anchor device 12 is coupleable to a door frame or other fixed location. The anchor device 12 includes strap 14 that is configured to wrap around and secure to the user or the fixed location. In some embodiments, the strap 14 is replaced with a cuff that can be held by the user. In other embodiments, the anchor device 12 includes any other suitable fastener.

The anchor device 12 includes a housing 16 attached to the strap 14 and configured to internally house various components of the retraction device 10. A display 18 is formed on the housing 16 and configured to display data related to the use of the retraction device 10. In some embodiments, the display 18 includes a touchscreen having buttons to toggle through various screens illustrated on the display 18. In other embodiments, buttons are incorporated into the housing 16. An input/output 24 enables the retraction device 10 to couple to various remote devices including, but not limited, to a computer, a handheld device, a watch, etc., to transfer data between the retraction device 10 and the remote device. In some embodiments, the retraction device 10 includes a wireless transceiver 20 (shown in FIG. 6) to transfer data received from a sensor (described below) to a remote device, for example, a remote computer or handheld device. In some embodiments, the remote device includes an application or software for compiling and analyzing the data received from the sensor. The application and/or software enables the user to track workout routines and workout measurements. In some embodiments, the wireless transceiver 20 is a Bluetooth transceiver. In some embodiments, the wireless transceiver 20 is cellular at any level, for example, 4G, 5G, 6G, etc. An indicator 22 is also provided on the housing 16 to send alerts to a user during use of the retraction device 10. In one embodiment, the indicator 22 is a light that sends visual alerts to the user. In another embodiment, the indicator 22 is a speaker that sends audible alerts to the user. In yet another embodiment, the housing 16 includes both a speaker and a light.

In some embodiments, the application or software utilizes an optical sensor of a mobile device to track movement of the user with the device 10. For example, the user can position the mobile device to face the user so that the optical sensor or camera of the mobile device detects the user's movement while using the device 10. The application or software includes data related to the user's movement in the data tracked during the workout routine.

Figure 2:
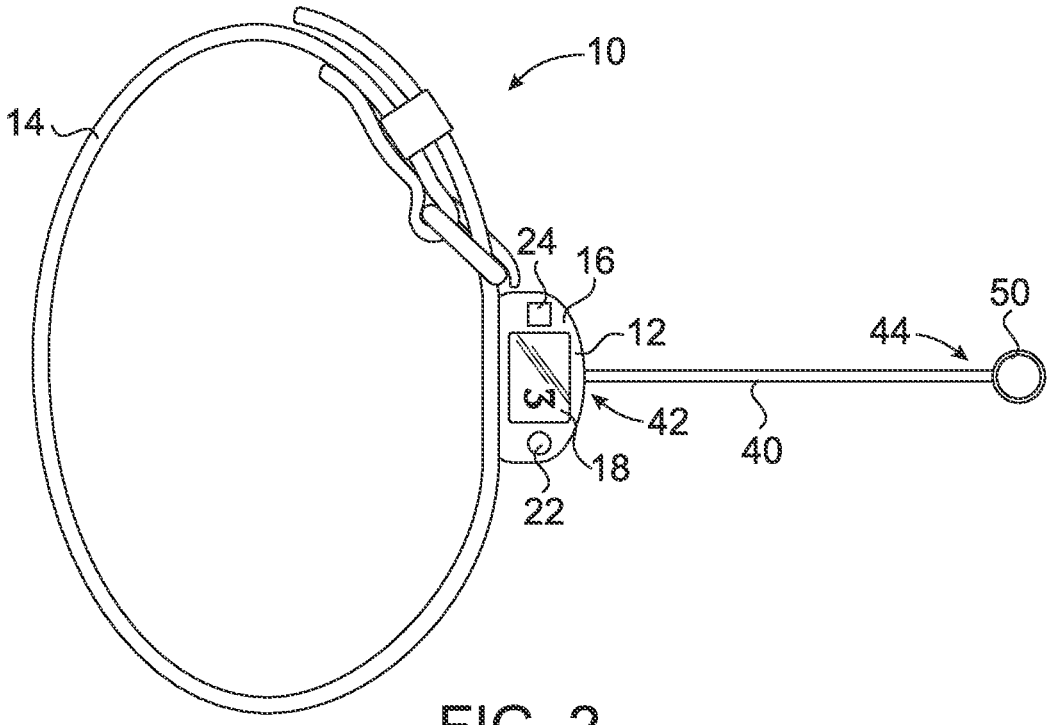
FIG. 2 is a top view of the retraction device, shown in FIG. 1, wherein the retractable cable is in an extended position.

An extendable and retractable cable 40 extends from the housing 16 from a housing end 42 to a free end 44. In the illustrated embodiment, the cable 40 extends approximately from a center of a front side of the housing 16. In some embodiments, the cable 40 extends from any location of any side of the housing 16. In some embodiments, the cable 40 is formed from any material and has any elasticity. The cable 40 is configured to move between a retracted position (shown in FIG. 1) and an extended position (shown in FIG. 2). When moving from the retracted position to the extended position, the free end 44 of the cable 40 moves away from the housing 16. When extending from the extended position to the retracted position, the free end 44 of the cable 40 moves toward the housing 16. The cable 40 is biased toward the retracted position. In some embodiments, the cable 40 is capable of being locked at any position, for example, the retracted position, the extended position, or at a position between the retracted position and the extended position.

Figure 3:
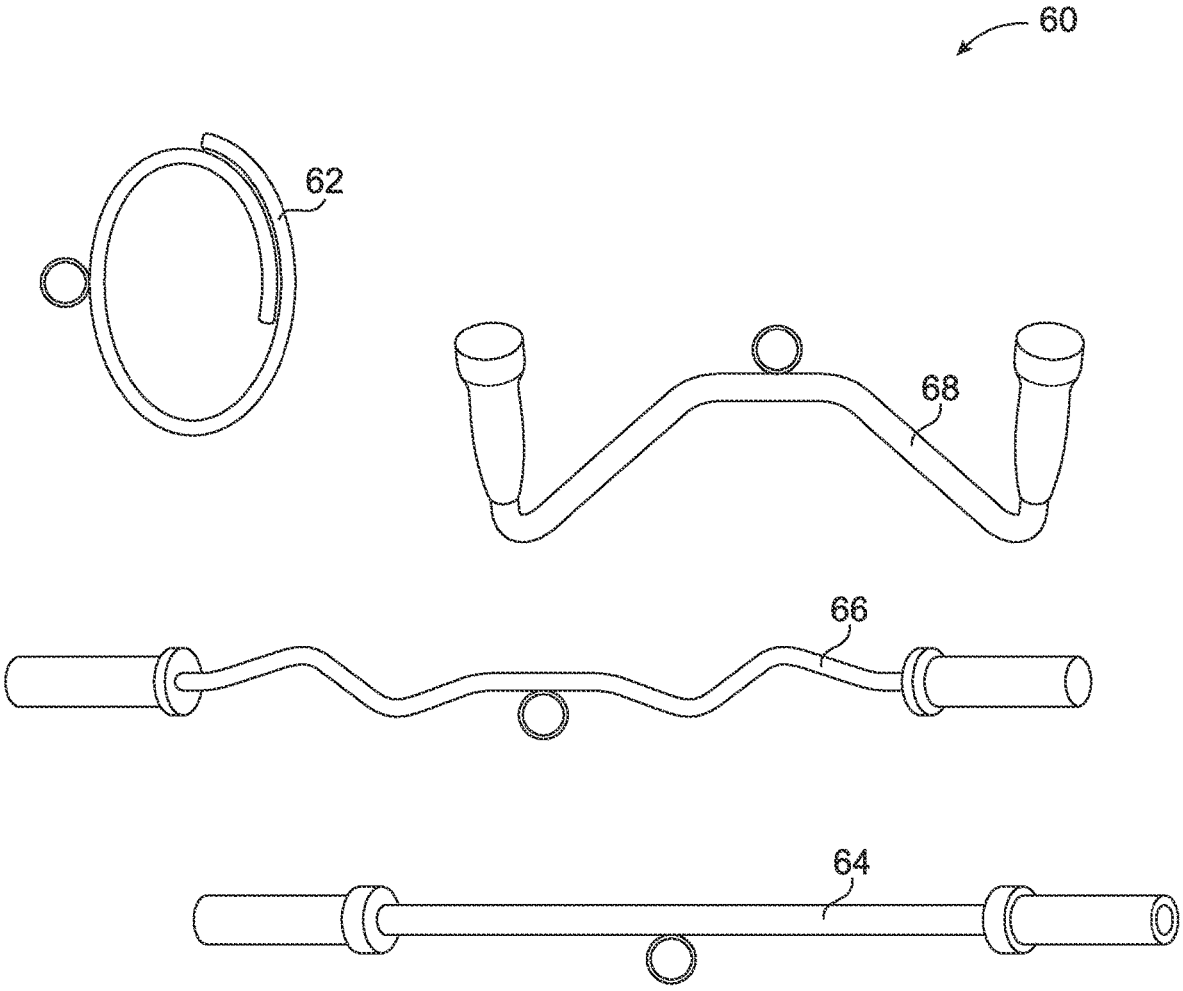
FIG. 3 is a top view of a plurality of exemplary attachment mechanisms that are configured to couple to a free end of the retractable cable, shown in FIGS. 1 and 2.

A fastener 50 is coupled to the free end 44 of the cable 40. In the illustrated embodiment, the fastener 40 is a clip. The fastener 50 is coupleable to an attachment mechanism 60 that is configured to be gripped by a user or is coupleable to a load. FIG. 3 illustrates a plurality of exemplary attachment mechanisms 60 including a strap 62, a long two-handed bench press bar 64, a short one-handed bar 66, and a short two-handed bar 68. It will be appreciated that any of the attachment mechanisms 60 shown in FIG. 3 are usable during exercise. Additionally, the strap 62 is useable to attach to and move a load. Any other exercise or load moving attachments are contemplated by this disclosure, for example, other cuffs, bars, and/or handles for exercise routines. In some embodiments, the attachment mechanisms 60 include a strap, head gear, or other apparatus to attach to a user's head to work out the user's neck. It will be appreciated that the cable 40 is coupleable to any extremity including arms, legs, or head. It will be appreciated that the retractors described herein utilize muscles on both sides of the body because a pull on one limb results in a push on the limb. In some embodiments using a retractor on the arms at the same time as using a retractor on the legs results in a full body workout.

During use, the cable 40 is moved between the retracted position and the extended position for exercise or load moving. A tensioning mechanism (as described below) adds tension to the cable 40 to resist movement of the cable 40 between the retracted position and the extended position. In some embodiments, the tension provides resistance during exercise. In other embodiments, the tension adds resistance to ease the movement of a load. In some embodiments, the tensioning mechanism locks the cable 40 and prevents movement of the cable 40. For example, the device 10 includes a stop button or braking mechanism, in some embodiments, to lock the cable 40. A ratchet system is provided, in some embodiments, to retract the load. In some embodiments, the tensioning mechanism is at least one of spring, a magnet, an electronic resistance device, a motor, and an elastic cable to create tension attributable to the retractable cable. The tensioning mechanism provides consistent or variable resistance to the retractable cable. In some embodiments, the tensioning mechanism is a screw type resistance device with a spring or other tensioning material that can run perpendicular or at some other angle to the housing. This embodiment enables the tension to be increased by tightening the spring or other tensioning material by turning the housing or a dial attached to the housing or the axle or a spooling other device to which the spring is attached so that the housing itself compresses the spring or an internal disk or the turning of the axle compresses the spring. In some embodiments, the tensioning mechanism is automatically adjusted by the control circuitry. In some embodiments, the tension is increased and decreased with a button, a tab, a lever, a dial, a slide device, a screw, or the like. In some instances the spring is of uniform width, thickness and shape, in other instances the spring can have varying widths, thicknesses, or shapes resulting in varying tension and resistance when the spring is tightened or compressed.

The control circuitry 70 measures various properties of the cable movement. In some embodiments, the control circuitry 70 measures a number of extensions of the cable 40, a time of use, a distance traveled by the cable 40, a weight of a load coupled to the cable 40, a velocity of the cable 40, an acceleration of the cable 40, a vector of the cable 40, a direction of the cable 40, a force applied to the cable 40, an altitude of the cable 40, and/or a location of the cable 40. It will be appreciated that the preceding list in not an exhaustive list of properties that are capable of being measured by the control circuitry 70. The control circuitry 70 provides visual or auditory feedback to one of the indicator 22 and/or the display 18. In some embodiments, the wireless transceiver 20 and/or the input/output 24 transfers feedback and/or data to the remote device. In some embodiments, the properties of the retractable cable 40 is transmitted by wired or wireless connection to a display utilizing any software or application necessary to provide such display. In some embodiments, the input/output includes a USB input/output or other suitable connection that enables another device to be charged while operating the device 10. For example, in one embodiment, the device 10 generates electricity that charges a phone or other device while operating the device 10.

In some embodiments, the application/software provides data related to a workout routine or measurements. The data includes, but is not limited to number of repetitions, total length of retractions, resistance levels used, steps, and total work. In some embodiments, total work is measured in at least one of joules, newton-meters, horsepower-hours, foot-pounds, kilowatt-hours, foot-poundals, and/or liter-atmospheres. The application/software is capable of measuring data from more than one retractor or cable 40. For example, multiple cables attached to the arms and legs provide data to the application/software, in some embodiments. In some embodiments, the control circuitry measures a distance based on pull length of the cable. In some embodiments, the control circuitry monitors heart rate with a heart rate monitor in cuffs, bands, belt, or otherwise. In some embodiments, the control circuitry measures body temperature, blood pressure, EKG, blood sugar. In some embodiments the control circuitry and processor can use measurement data to make calculations including but not limited to total work, total repetitions, calorie burn, average heart rate, average blood pressure, average body temperature, and to display such calculations in an format such as a table or chart.

The application/software enables the user to establish an account with a profile, a performance rating system, the ability to join different groups, or communities, based on profile and/or performance, the ability to be interactive for goods and services, and ideas and media platform connections. In some embodiments, the application/software links to a workout community of users to enable each user to stream or otherwise share their performance and compare their progress to others.

A user agreement includes licensing fees or other arrangements for payments to be made in the event of any use including use that results in income, earnings or other financial benefits achieved in conjunction with or related to use of the application/software, in some embodiments. In one embodiment, the application/software includes live interactive coaching, and the ability to broadcast from a smart device to other visual and/or audio devices for interactive coaching. In some embodiments, the interactive coaching is live, recorded, or via artificial intelligence. The application/software communicates with the user to report status, give instructions, provide coaching, provide interaction, and answer questions. For example, in some embodiments, the device 10 is supported by artificial intelligence so that a smart device with the application operates as a trainer that is connected to and interacts with other trainers and other users for a complete workout experience. The artificial intelligence observes and records workouts/action of the device 10 to issue coaching or other instruction. In some embodiments, the artificial intelligence automates calculations for suggestions, tracking, and overall performance review and enhancement recommendations.

Figure 4:
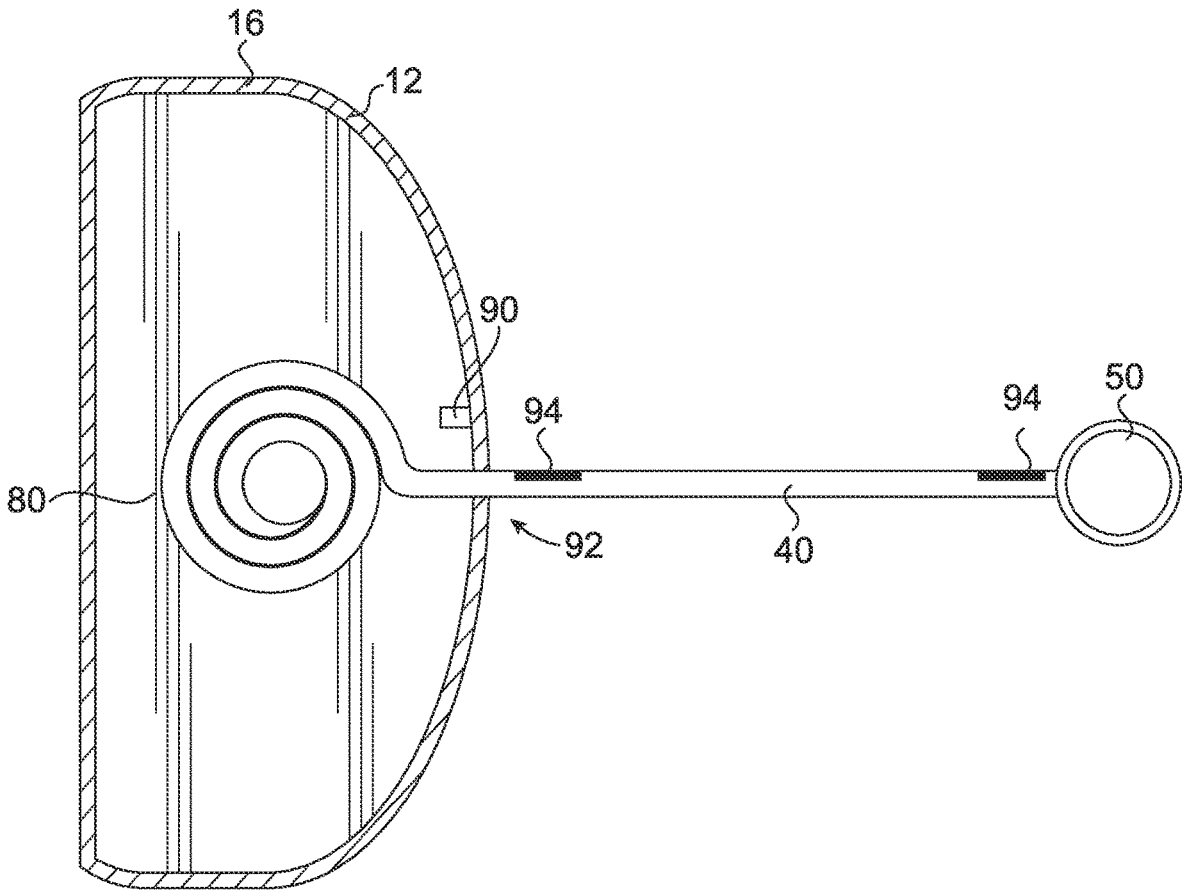
FIG. 4 is a top view of the retraction device, shown in FIGS. 1 and 2, including a cut-away view of the anchor device showing a resistance device that the retractable cable is connected to, wherein at least one RFID tag is attached to the retractable cable and an RFID reader is positioned in the housing.

Referring now to FIG. 4, a resistance device 80 is positioned within the housing 16. In the illustrated embodiment, the resistance device is a spool and the cable 40 is wound around the resistance device 80. In other embodiments, the resistance device 80 is an axle, an electric motor, or other suitable resistance device and the cable 40 is connected to the resistance device 80. The housing end 42 of the cable 40 remains attached to the resistance device 80 at all times during extension and retraction of the cable 40. A radio frequency identification (RFID) reader 90 is positioned within the housing 16. The RFID reader 90 is positioned adjacent an opening 92 in the housing 16 through which the cable 40 extends. A plurality of RFID tags 94 are positioned on the cable 40. In an exemplary embodiment, the RFID tags 94 are equally spaced along a length of the cable 40. As the cable 40 extends from and retracts into the housing 16, at least some of the RFID tags 94 pass the RFID reader 90 and are read by the RFID reader 90. The control circuitry 70 determines properties of the cable's movement based on data received from the RFID reader 90, wherein the data is indicative of when each RFID tag 94 passed the RFID reader 90. In some embodiments, the RFID reader 90 is used to measure velocity, acceleration, and/or distance.

Figure 5:
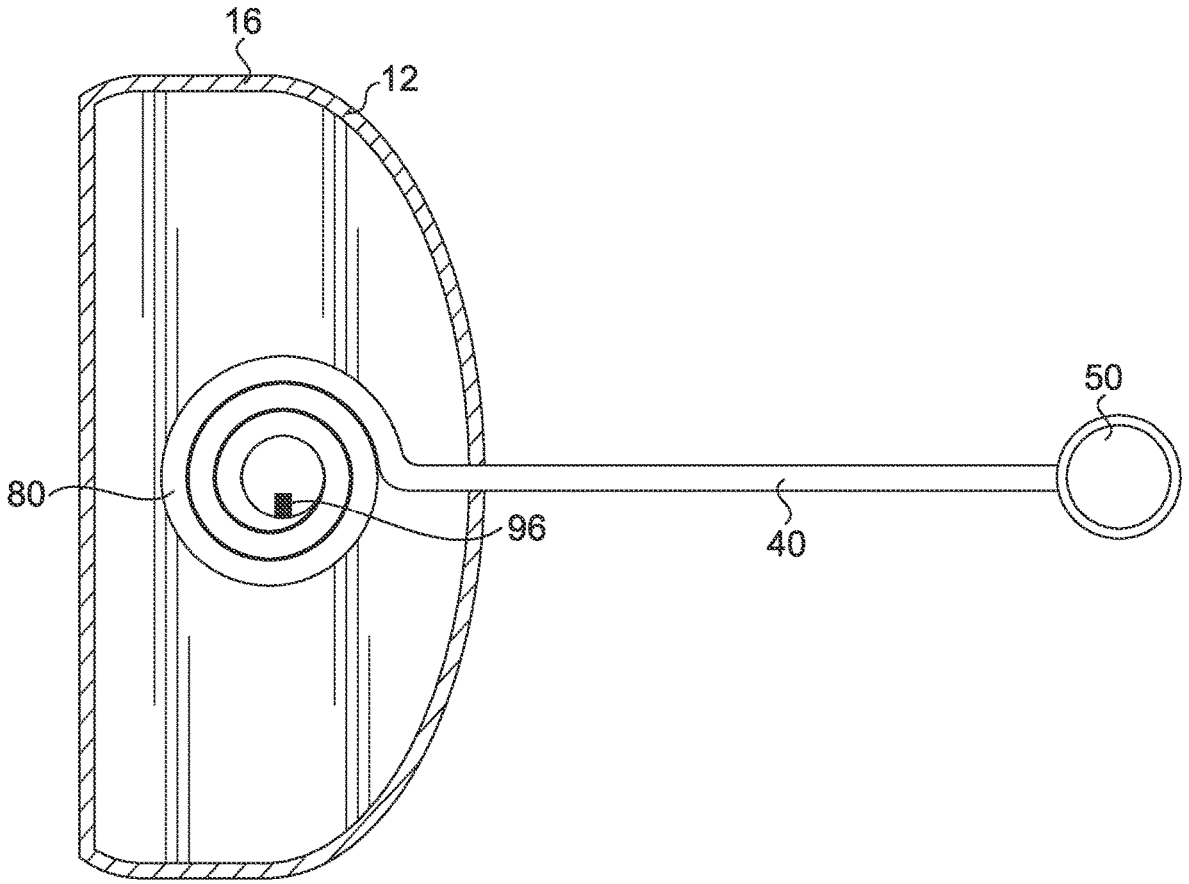
FIG. 5 is view similar to FIG. 4, wherein the anchor device includes a sensor.

In one embodiment, shown in FIG. 5, the resistance device 80 includes at least one sensor 96 to measure properties of the resistance device 80. For example, in one embodiment, the sensor 96 is an accelerometer. In other embodiments, the sensor 96 includes any sensor suitable for measuring properties of the device. In some embodiments, the properties include a number of revolutions, a velocity of revolutions, and/or an acceleration of the resistance device 80. The control circuitry 70 uses data from the sensor 96 to calculate properties of the cable 40. It will be appreciated that the RFID reader 90 of FIG. 4 and the sensor 96 are used together in some embodiments. In other embodiments, the RFID reader 90 and the sensor 96 are used independently. It will be appreciated that in one embodiment, at least one of the RFID reader 90 and/or the sensor 96 tracks a number of times that the cable 40 is extended and retracted. In some embodiments, the display 18 includes a counter that displays the number of extensions and retraction. In other embodiments, a mechanical counter tracks the number of extensions and retractions. It will be appreciated that, in some embodiments, the sensor includes a mechanical counter. In some embodiments, the sensor 96 and/or RFID reader 90 has the ability to measure a speed, a velocity, an acceleration, a length, a weight, a work and energy transfer, a vector, a direction, or other physical and locational attribute of the retractable cable 40.

Figure 6:
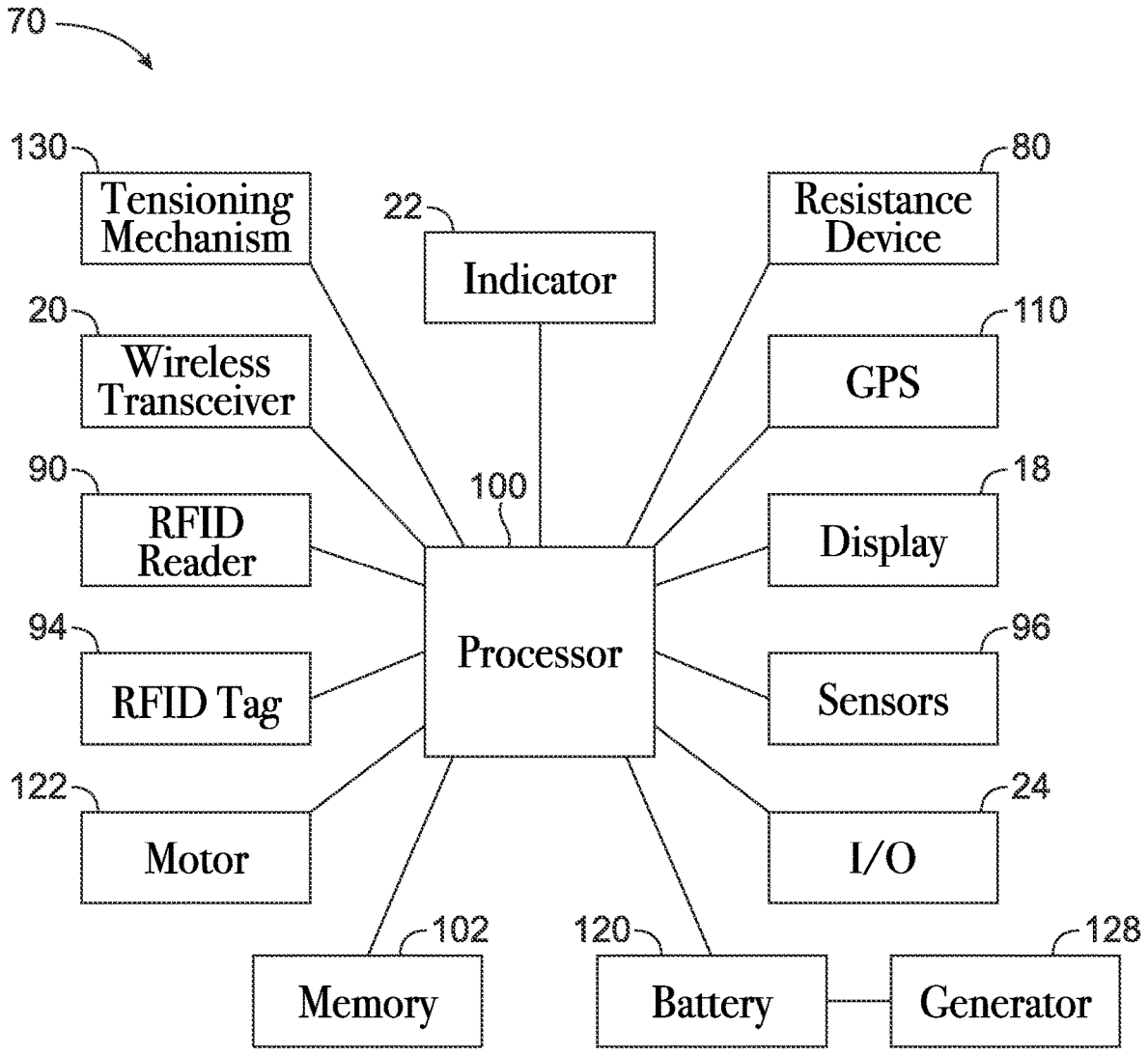
FIG. 6 is a schematic view of control circuitry for the retraction device, wherein all or part of the control circuitry is housed in the anchor device or can be housed separately from the anchor device.

The control circuitry 70 is illustrated in FIG. 6 and includes at least one processor 100 and a memory 102. In some embodiments, the control circuitry 70 is housed in the housing 16. In other embodiments, at least a portion of the control circuitry 70 is housed in a remote device that is in communication with the device 10. The memory 102 stores instructions that cause the processor to perform as described herein. The display 18, the input/output 24, the wireless transceiver 20, and the indicator 22 are all coupled to the processor 100 so that the processor 100 provides feedback as described herein. The RFID reader 90 and the sensor 96 are also coupled to the processor 100. The memory 102 includes instructions that, when read by the processor 100, cause the processor 100 to calculate and determine the properties of the cable 40 described above based on signals from the RFID reader 90 and the sensors 96.

The control circuitry 70 includes a global positioning system (GPS) 110, in some embodiments. Based on data from the GPS 110, the processor 100 determines a location and altitude of the retraction device 10. In some embodiments, the GPS 110 calculates a direction of movement of the free end 44 of the cable 40. Accordingly, the processor 100 uses the data from the GPS 110 to determine a vector of the cable 40 as the cable 40 is extended and retracted.

A battery 120 is provided to power the control circuitry 70. In the illustrated embodiment, the battery 120 also powers an electric motor 122. In some embodiments, the electric motor 122 provides forces on the cable 40 opposite the extension of cable 40. Accordingly, the motor 122 provides tension on the cable 40 to assist in exercise or moving a load.

The control circuitry 70 or mechanics of the retraction device 10 also include one or more power generator 128 electrically or otherwise coupled to at least one of the cable 40 the resistance device 80. In some instances, the generator 128 can be part of the resistance device or can be separate from or partially part of the resistance device 128. In some embodiments, one or more resistance devices 80 is a power generator 128. In another embodiment, the power generator 128 is separate from the resistance device. In some embodiments, the power generator 128 is connected to the retraction device 10 including to the processor 100 of the retraction device 10 and then to an item or device (e.g. battery, battery pack, phone, or electrical grid) using generated electricity/power from the retraction device 10. In some embodiments, the power generator 128 is built utilizing two or more disks, for example magnets and wiring configured on the disks so as to provide for the generation of power. For further power generation, a manual crank generator system may be provided to charge the device 10 without a workout.

The power generator 128 is configured to generate an electrical charge or current when one or more of the cable 40 or the resistance device 80 or any disk moves in either direction. For example, the electrical charge is generated, when the cable 40 extends or retracts. In one embodiment, the electrical charge is generated both when the cable 40 extends and retracts. In another embodiment, the electrical charge is generated when the resistance device 80 moves in any manner including spinning. In one embodiment, the power generator 128 includes coils of copper wire or other material that spin inside a magnetic field to create a flow of alternating current (AC) electricity inside the wire. In some embodiments, the power generator 128 is a dynamo or other type of design that paxleuces direct current (DC) electricity. In an illustrative embodiment, the electrical charge is stored in the battery 120 to power the device 10 and the control circuitry 70 or to charge other devices through a wired or wireless connection. In some embodiments, the electrical charge is stored in a separate attached or removable battery that is usable to power the control circuitry or other devices. In one embodiment, the battery 120 is removable and usable to power other devices (e.g. battery, battery pack, phone, electrical grid, or EMS/electroshock therapy devices to upgrade the workout). In another embodiment, there can be charging mechanisms such as a USB or C type port attached or separate for charging other devices directly.

Figure 7:
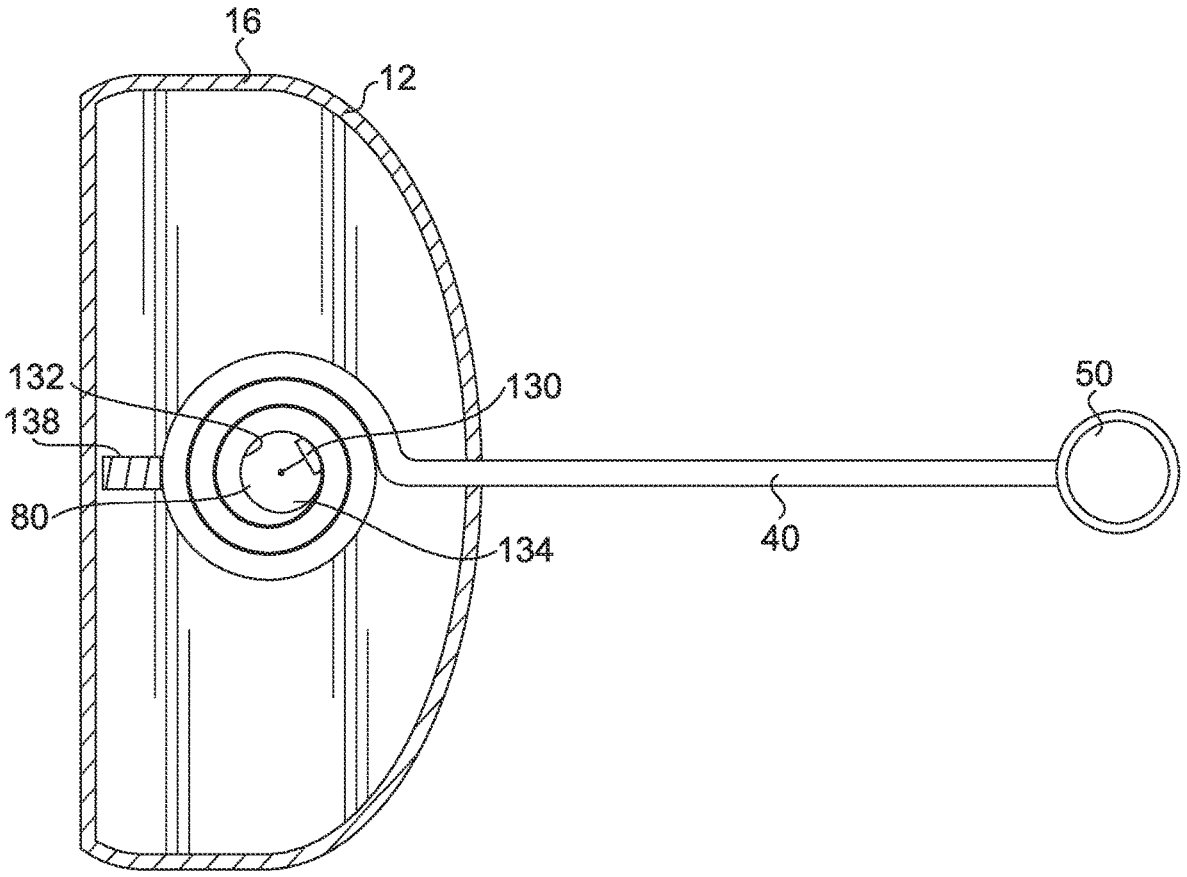
FIG. 7 is a view similar to FIG. 4, wherein a tensioning mechanism is provided to restrict movement of the resistance device.

Referring now to FIG. 7, a tensioning mechanism 130 restricts movement of the cable 40 between the retracted position and the extended position. In some embodiments, the tensioning mechanism 130 locks the cable 40 and prevents movement of the cable 40. In some embodiments, the tensioning mechanism 130 is disengaged and does not restrict movement of the cable 40. In some embodiments, the tensioning mechanism 130 includes a plate, for example, a plate with a felt pad. In the illustrated embodiment, the tensioning mechanism 130 is moveable into contact with the resistance device 80. The tensioning mechanism 103 is moveable into contact with an inner circumference 132 of the resistance device 80 or a sidewall 134 of the resistance device 80. The more contact made between the tensioning mechanism 130 and the resistance device 80, the more friction that is created to slow the resistance device 80. In some embodiments, the resistance device 80 is metal and the tensioning mechanism 130 is a magnet. In such an embodiment, the tensioning mechanism 130 does not directly contact the resistance device 80, but rather, the resistance device 80 is slowed by magnetic force. In the illustrated embodiment, the resistance device 80 includes a spring 138 that retracts the cable 40.

Figure 12:
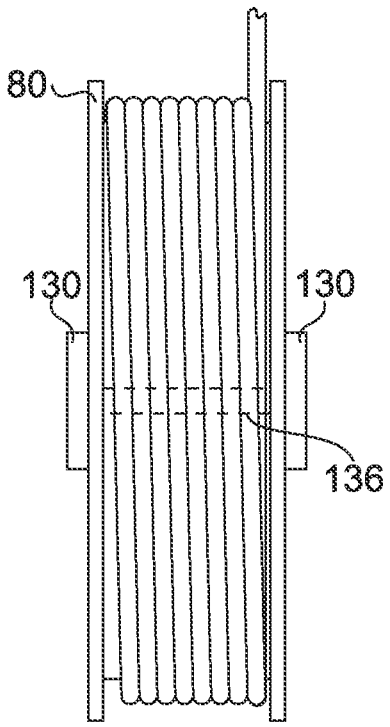
FIG. 12 is a top view of an embodiment of a dual pad tensioning mechanism.
Figure 13:
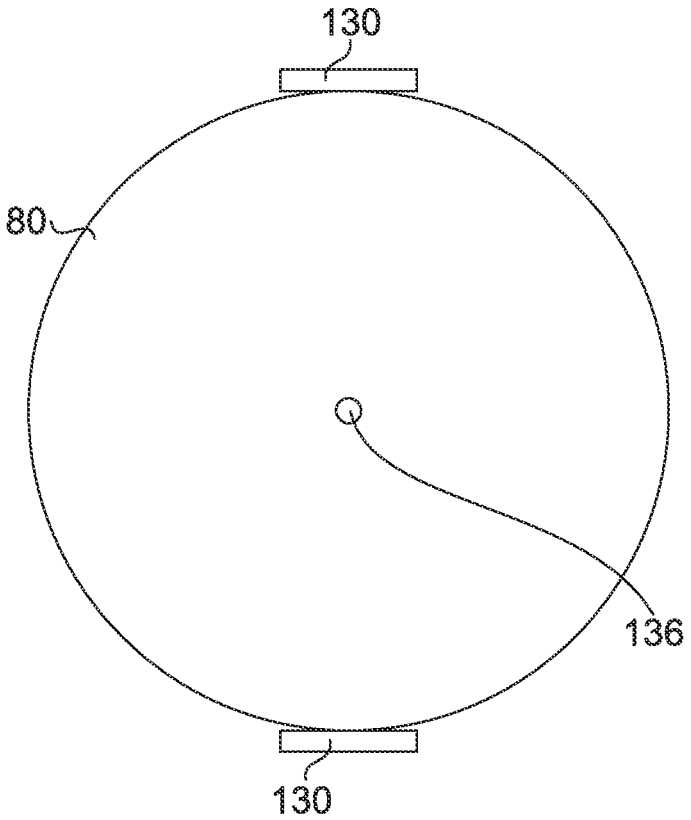
FIG. 13 is a side view of another embodiment of a dual pad tensioning mechanism.

In some embodiments, the tensioning mechanism 130 includes dual pads/resistance materials. The tensioning mechanism 130 provides resistance on one or more positions along an edge of resistance device 80, in one embodiment. The tensioning mechanism 130 provides resistance on one or more positions along a side of the resistance device 80, in some embodiments. In an embodiment, the tensioning mechanism 130 provides resistance on one or more positions along both sides of the resistance device 80, as illustrated in FIG. 12. In an embodiment, the tensioning mechanism 130 provides resistance on one or more positions along a top and bottom of the resistance device 80, as illustrated in FIG. 13. In some embodiments, the tensioning mechanism 130 provides resistance from inside positions of the resistance device 80 and/or along an axle 136 upon which the resistance device 80 rotates. The dual pads, in some embodiments, provide opposite forces on the resistance device 80 to prevent deformation of the resistance device 80 and/or an axle 136 or other mechanism upon which the resistance device 80 rotates or moves. In an embodiment, the tensioning mechanism 130 provides resistance on one or more positions of the cable 40.

Figure 10:
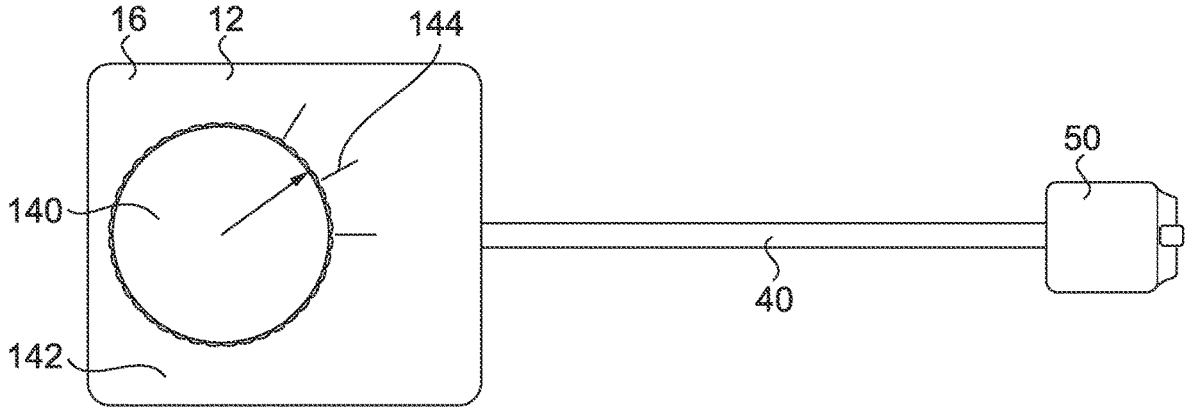
FIG. 10 is a top view of the anchor device, shown in FIGS. 1 and 2, wherein a dial is provided to adjust a tension of the retractable cable.

In an illustrated embodiment, the tensioning mechanism 130 is adjustable, for example, by adjusting a dial 140 (shown in FIG. 10) positioned on an outer surface 142 of the housing. The dial 140 is rotatable to different settings 144, each of which represent a different level of tension, for example, 1 pound of tension, 3 pounds of tension, and 5 pounds of tension. In another embodiment, adjustment of the tensioning mechanism 130 is controlled electronically, for example, by entering a tension setting into the display 18. In such an embodiment, the control circuitry 70 electronically adjusts the position of the tensioning mechanism 130. It will be appreciated that in some embodiments, the dial 140 is a sliding connector.

Figure 8:
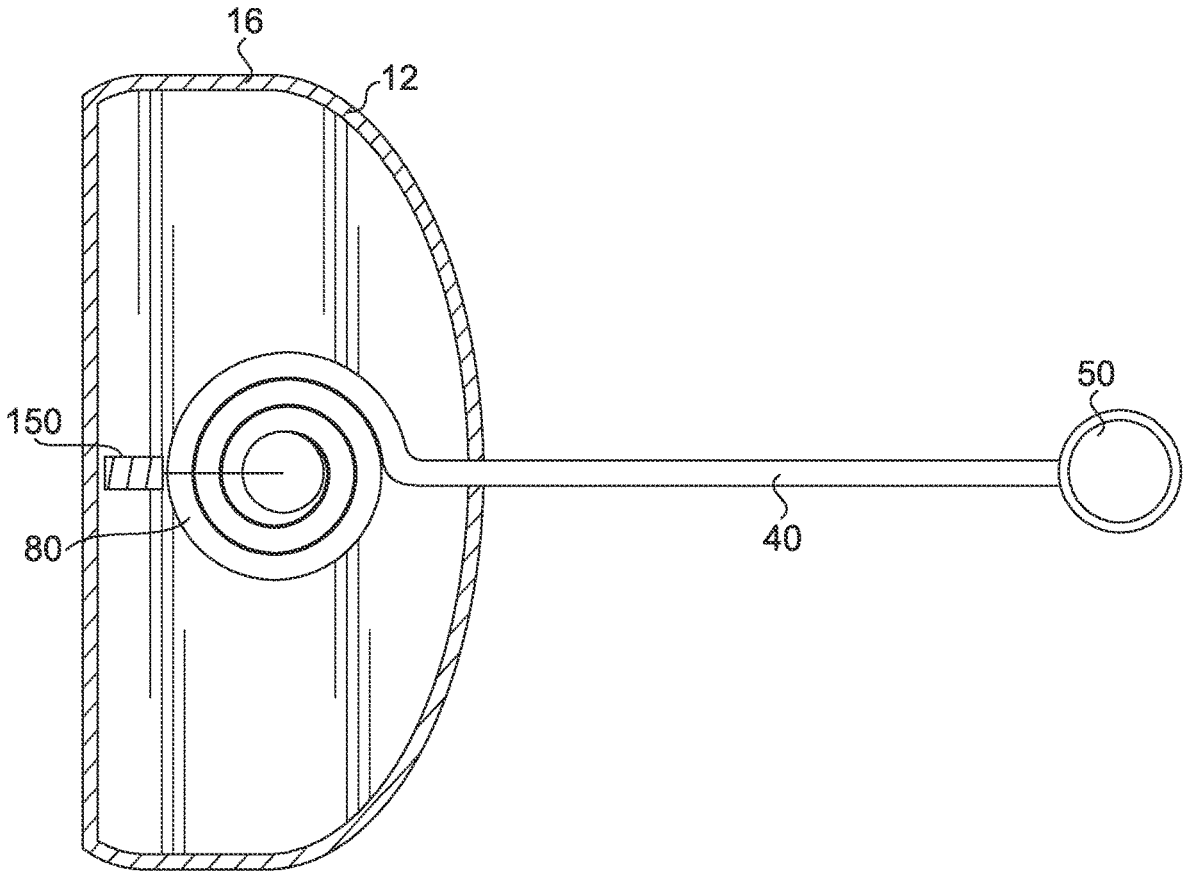
FIG. 8 is a view similar to FIG. 4, wherein a spring is provided to restrict movement of the resistance device.

Referring to FIG. 8, in some embodiments, a spring 150 biases the resistance device 80 to provide tension to the cable 40. The spring 150 is usable with the tensioning mechanism 130, in some embodiments. In one embodiment, the amount of tension provided the spring 150 is adjustable by stretching the spring 150. For example, the dial 140 is used in one embodiment to stretch the spring 150. Increased tension on the cable 40 is provided by the ability to tighten spring, in some embodiments. In some embodiments, the spring 150 is adjusted electronically by the control circuitry 70.

Figure 9:
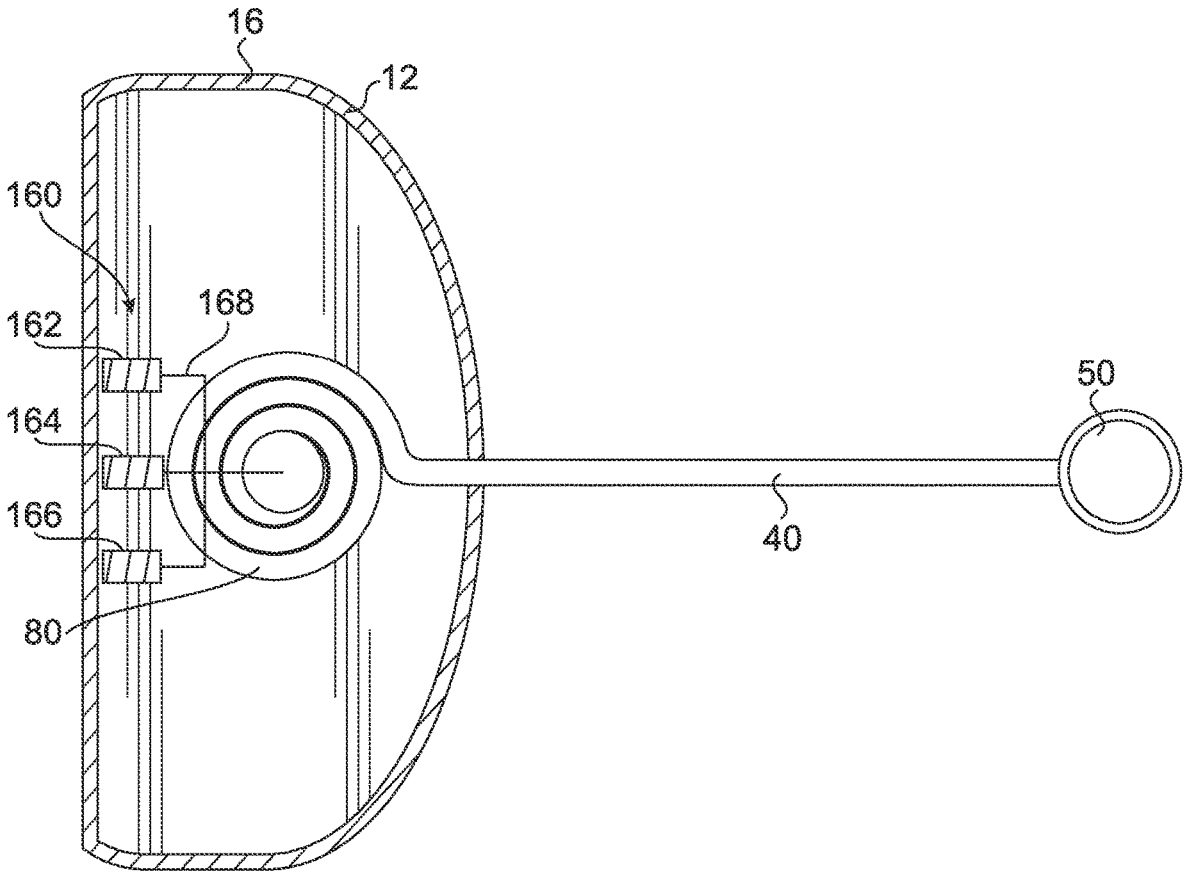
FIG. 9 is a view similar to FIG. 4 and including a gear system to attach to one of plurality of springs that restrict movement of the resistance device.

In the embodiment shown in FIG. 9, the retraction device 10 includes a plurality of springs 160. In one embodiment, each spring 160 provides a different measure of tension. For example, spring 162 provides one pound of tension, spring 164 provides three pounds of tension, and spring 166 provides five pounds of tension. The spring 160 is selectable by the dial 140, in some embodiments, or electronically, in some embodiments, by using a gear system 168 to couple the cable 40 to one of the springs 162, 164, or 166. In some embodiments, multiple springs 160 are coupleable to the cable 40 to provide a different tension. For example, if the cable 40 is coupled to spring 162 and spring 166, six pounds of tension is provided to the cable 40. Coupling the cable 40 to all three springs 160, would provide eleven pounds of tension to the cable 40.

Figure 11:
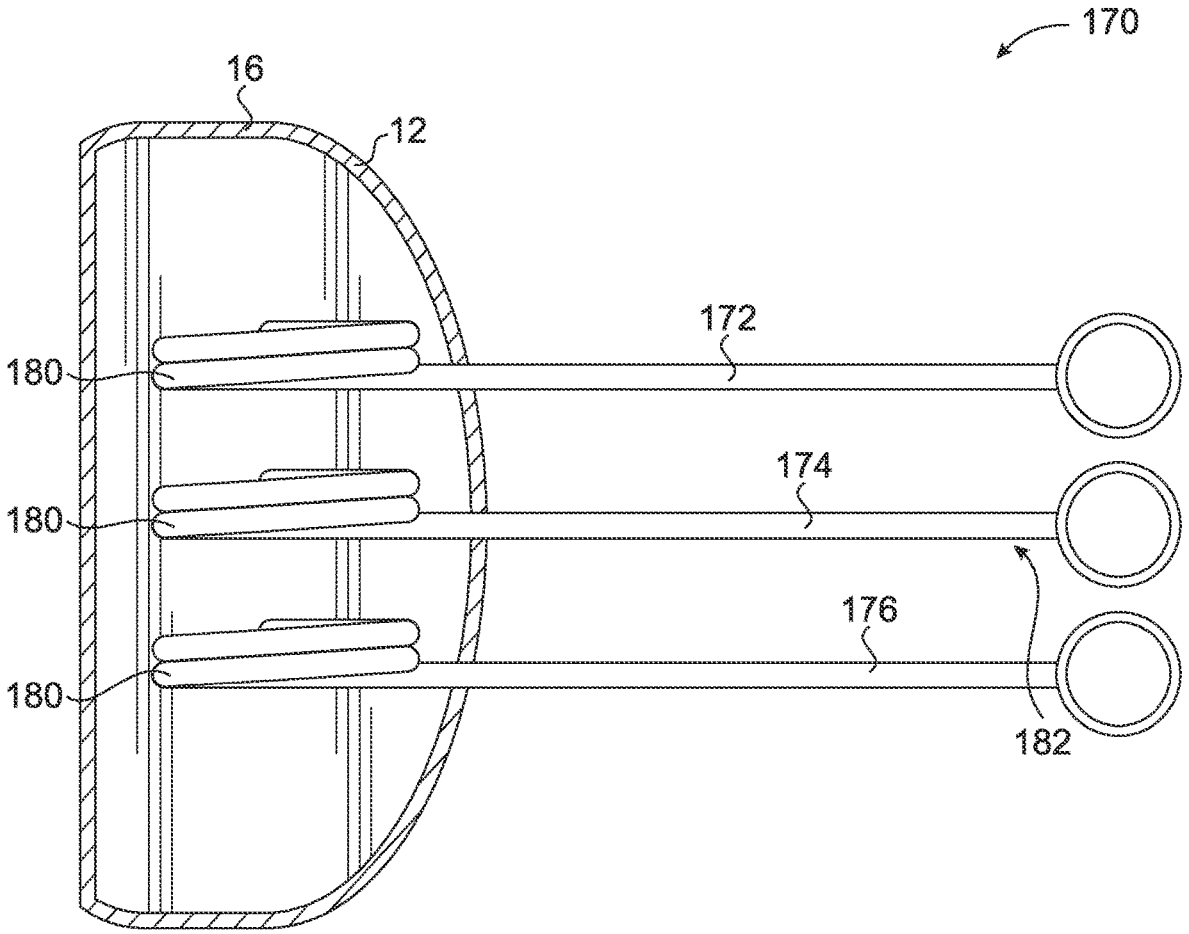
FIG. 11 is a view similar to FIG. 4 and showing a plurality of retractable cables.

In the embodiment shown in FIG. 11, the retraction device 10 includes a plurality of extendable and retractable cables 170. Each cable 170 is would around a separate resistance device 180. Accordingly, each cable 170 is extendable and retractable at a different speed, acceleration, and direction. In some embodiments, a free end 182 of each cable 170 is coupleable to a different body part of a user so that the user can exercise and practice using full body motion. For example, to practice a baseball swing, one cable 170 is coupleable to each arm and one cable 170 is coupleable to a leg of the user. Although the illustrated embodiment only shows three cables 170, the retraction device 10 includes any number of cables 170, in some embodiments. In an embodiment with fours cables 170, two cables 170 are coupleable to each arm and two cables 170 are coupleable to each leg. In some embodiments, the plurality of cables 170 includes multiple internal tensioning/resistance device and can be positioned to go in any direction, for example, opposite direction or any other direction from the retraction device 10. This provides, a single device 10 that covers two or more points for direction, for example, two arms, two arms and two legs, or any other combination. This configuration also enables heavier commercial or industrial application that provides more than one lift at a time. Additionally, by enabling the cables 170 to expand in different directions, a collective spin rate for the power generator 128 is increased, which, in turn, increases a power yield from the retraction device 10.

In one embodiment, each cable 170 provides a different measure of tension. For example, cable 172 provides one pound of tension, cable 174 provides three pounds of tension, and cable 176 provides five pounds of tension. The cables 170 are tensioned, in one embodiment, using any of the tensioning mechanisms or springs describe herein. The cables 170 are selected by attaching at least one cable 170 to an attachment mechanism 60 or a load. In some embodiments, multiple cables 170 are useable to provide different tensions. For example, if cable 172 and cable 176 are used, six pounds of tension is provided. Coupling an attachment mechanism 60 or load to all three cable 170, would provide eleven pounds of tension. In some embodiments, the tension of each cable 170 is adjustable as described herein to increase the number of tension combinations. Additionally, in some embodiments, each cable 170 includes indicia or coloring to identify the cable 170.

Figure 14:
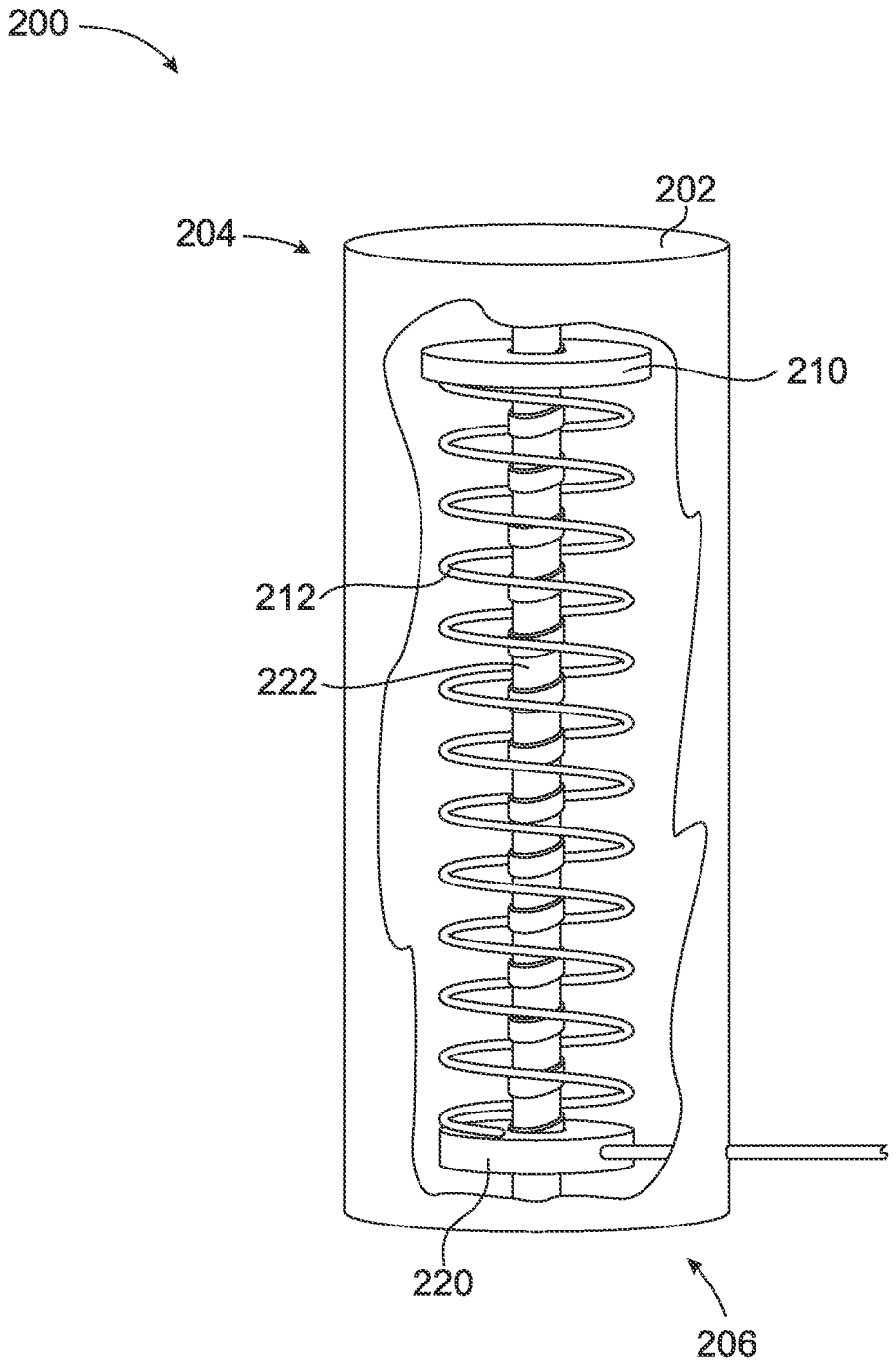
FIG. 14 is a schematic of another tensioning mechanism in accordance with an embodiment.
Figure 15:
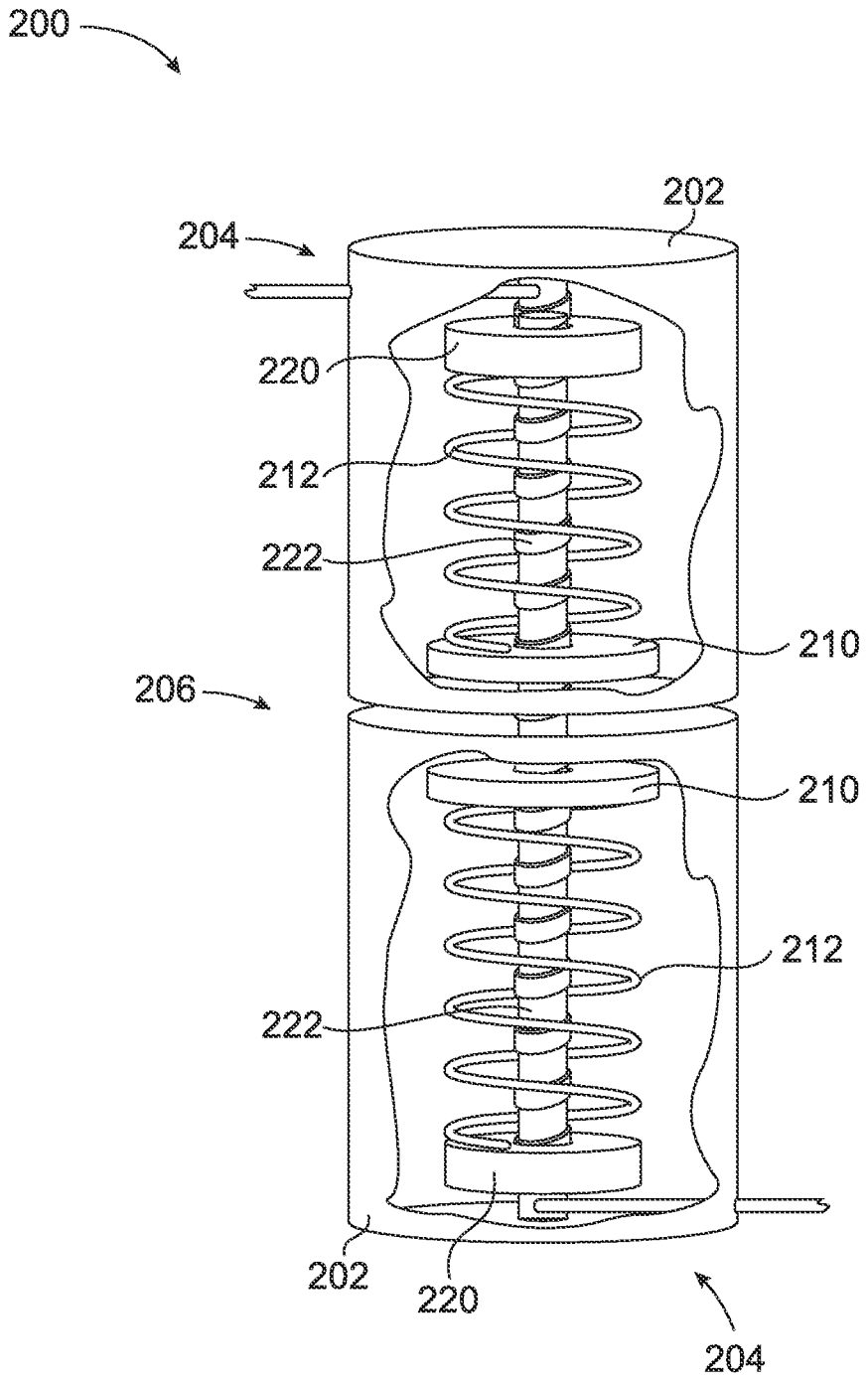
FIG. 15 is a schematic of yet another tensioning mechanism in accordance with an embodiment.
Figure 16:
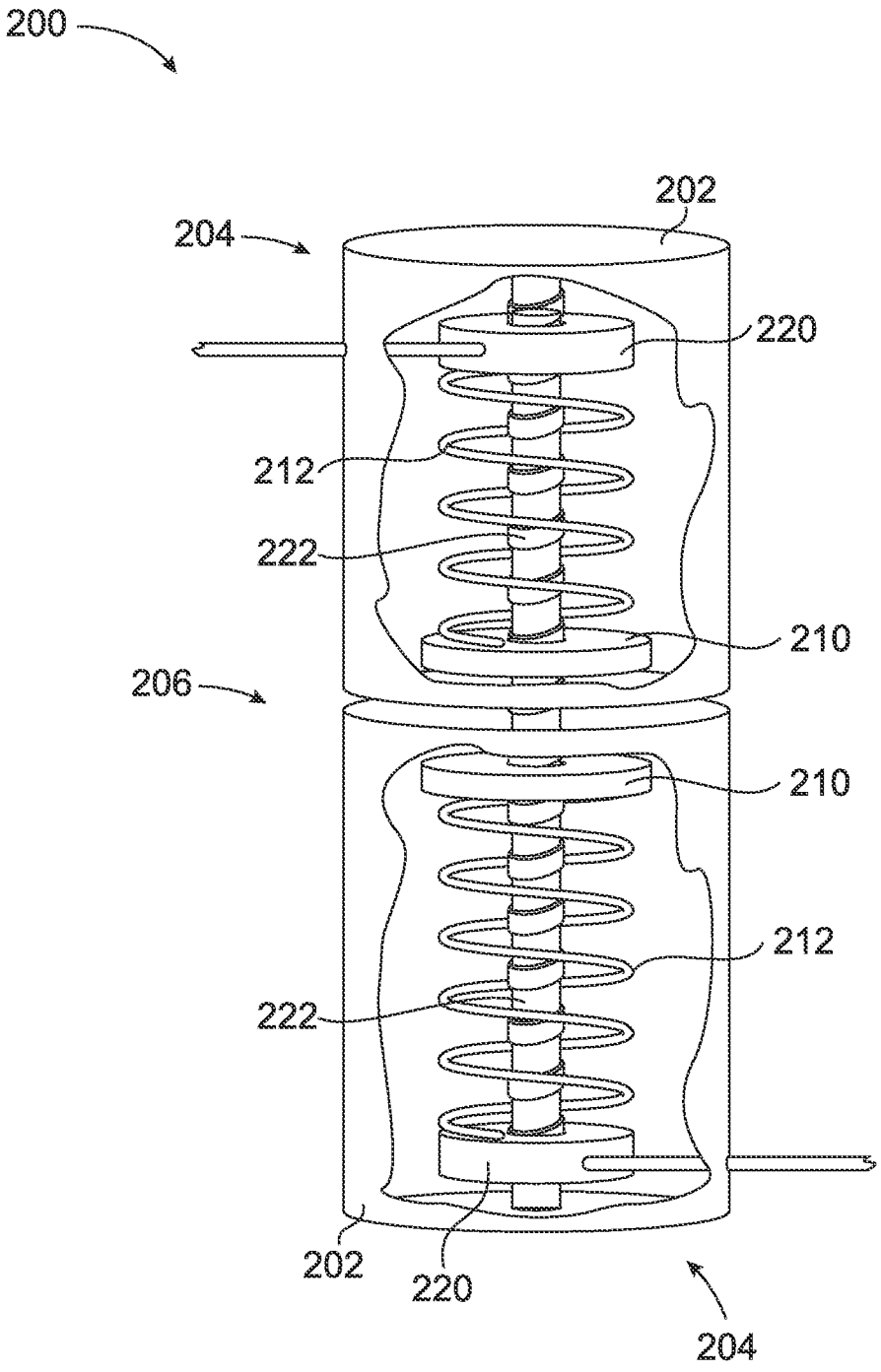
FIG. 16 is a schematic of a further tensioning mechanism in accordance with an embodiment.

Referring now to FIGS. 14-16, a tensioning mechanism 200 is formed integrally with a housing 202 on both a first end 204 and a second end 206. It will be appreciated that the tensioning mechanism 200 can have any orientation such that the tensioning mechanism 200 extends between a pair of side ends. The tensioning mechanism 200 includes a tensioning disk 210 that acts on a compression device 212, illustrated as a spring, at a first end 214 of the compression device 212. A second end 216 of the compression device 212 acts on moving disk 220. A movement bolt 222 extends through the compression device 212. The cable 40 is attached to either the moving disk 220, the compression device 212, or a device attached to, or made part of, the compression device 212.

During use, the movement bolt 222 acts on the compression device 212 to create tension. The moving disk 220 or disks are configured to move in up and down the bolt 222 when turning of the tensioning disk 210 occurs. The moving disk 220 also contains its own spring for retraction and resistance, in some embodiments. The resistance is increased by compressing the compression device 212, the material in the moving disk 220, the tensioning disk 210, or the housing 202. In another embodiment, friction devices are placed against the moving disk 220, the bolt 222 or both.

FIG. 14 illustrates a single direction pull cable 40 attached to the moving disk 220, the bolt 222, or a device attached to, or made part of, the bolt 222. FIG. 15 illustrates multiple direction pull cables 40 attached to separate bolts 222. That is, in the embodiment of FIG. 15, a first cable 40 attaches to a first bolt 222, and a second cable 40 attaches to a second bolt 222. In some embodiments, the first bolt 222 and the second bolt 222 are individually adjustable from opposite sides of the housing 202. In some embodiments, adjustment of the first bolt 222 causes adjustment of the second bolt 222, or vice versa. FIG. 16 illustrates multiple direction pull cables 40 attached to separate moving disks 220. That is, in the embodiment of FIG. 16, a first cable 40 attaches to a first moving disk 220 having an adjustable tension with a first bolt 222, and a second cable 40 attaches to a second moving disk 220 having an adjustable tension with a second bolt 222. In some embodiments, the first bolt 222 and the second bolt 222 are individually adjustable from opposite sides of the housing 202 to adjust the tension on the first disk 220 and the second disk 220. In some embodiments, adjustment of the first bolt 222 causes adjustment of the second bolt 222 so that both the first disk 220 and the second disk 220 are simultaneously adjusted, or vice versa.

Figure 29:
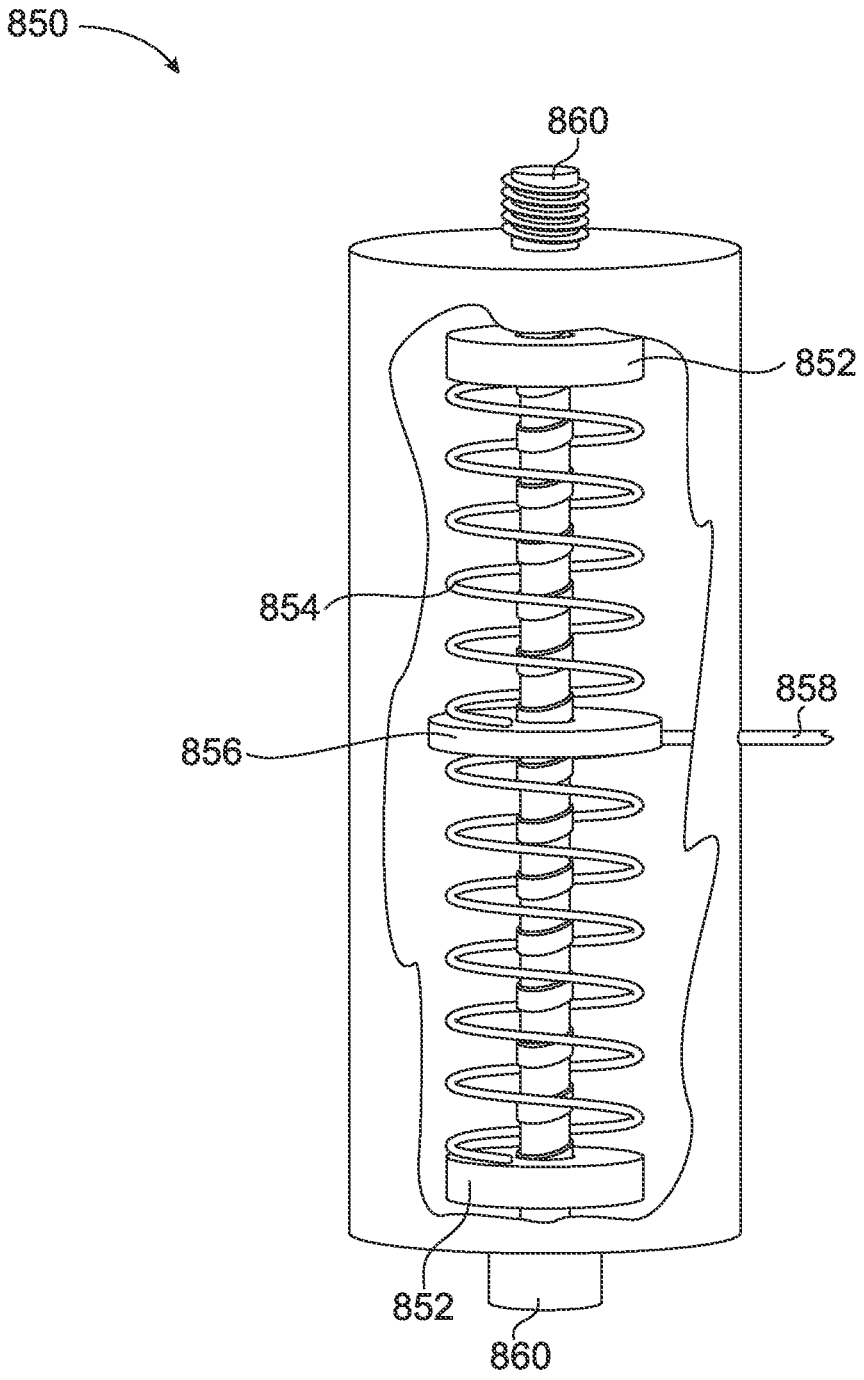
FIG. 29 illustrates another embodiment of a tensioning mechanism.

In an embodiment shown in FIG. 29, a tensioning mechanism 850 includes two tensioning disks 852 that move on a screw 854 towards or away from a moving disk 856 that is coupled to a cable 858. The two tensioning disks collapse onto the moving disk 856 or expand away from the moving disk 856 to adjust the tension on the moving disk 856. The tensioning mechanism 850 is scalable by coupling multiple tensioning mechanisms 850 together by attaching adjacent tensioning mechanisms 850 with a fastener 860 provided at the ends of each tensioning mechanism 850. In some embodiments, any one of the tensioning mechanisms shown in FIGS. 14-16 and 29, is coupleable and scalable. In some embodiments, one or more spring tensioning units are connected and disconnected to increase or decrease resistance levels. It will be appreciated that although the fastener 860 is shown as a screw mechanism, in some embodiments, the fastener 860 includes any fastener that enables the tensioning mechanism 850 to be coupled to at least one other tensioning mechanism 850 so that the resistance of the device is increased or decreased based on the number of tensioning mechanisms 850 coupled together. For example, if two tensioning mechanisms 850 having a maximum resistance of three pounds are coupled together, the device has a maximum resistance of six pounds.

Figure 30:
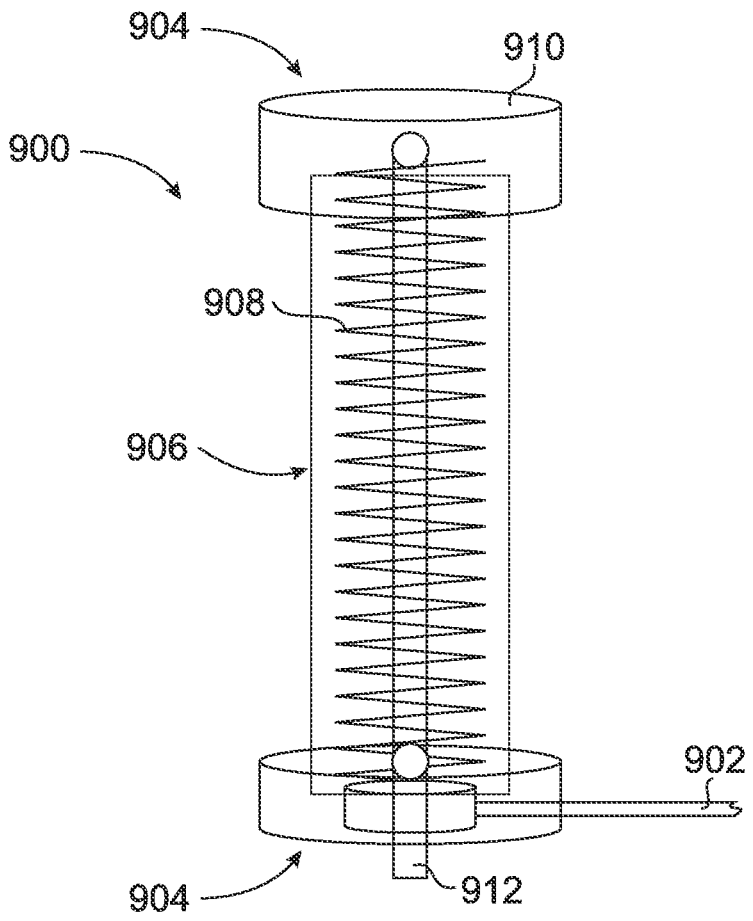
FIG. 30 illustrates yet another embodiment of a tensioning mechanism.

Referring now to FIG. 30, a tensioning mechanism 900 includes a cable 902 that is positionable at an end 904 or a middle 906 of the mechanism 900. A single spring 908 is provided or a spring 908 is positioned on each side of the cable 902. In some embodiments, the cable 902 is coupled to a spool. The spring 908 is contained in a housing 910 and by an axle 912. In the illustrated embodiment, resistance/retraction comes from torquing the spring 908 which causes the spring 908 to compress. Compression of the spring 908 causes restriction on movement of the cable 902.

All of the tensioning mechanisms described herein are of any resistance/retraction and are coupleable, modular and scalable. For example, in some embodiments, there are one or more retractor systems in a single fixed housing with a fixed or variable resistance method. In some embodiments, one or more retractors and retractor systems are provided in a case holder type housing for retractors that can be opened to add to reduce number of retractors. The coupleability can be by any type of means, screw in, clip connection, insertion connection and the like. The insertion method of coupleability would include a switch or dial which would guide and move the retractor system in and out of its connected mode thus providing the additional or less resistance (i.e. the slide over and insertion into model for the male connector to the female receiver).

Figure 17:
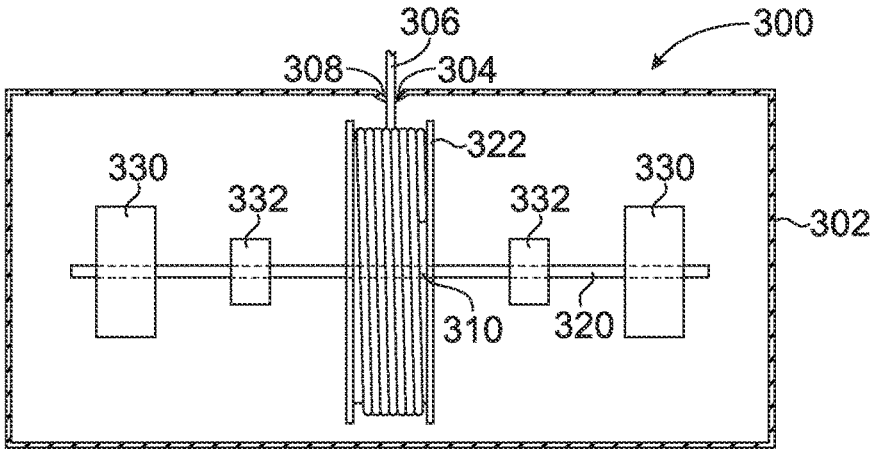
FIG. 17 is a top cross-sectional view of a retraction device in accordance with an embodiment.
Figure 18:
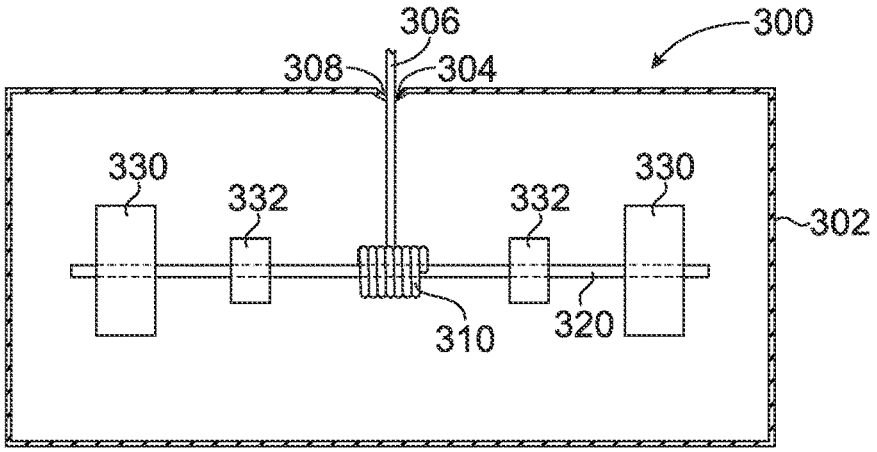
FIG. 18 is top cross-sectional view of another retraction device in accordance with an embodiment.
Figure 19:
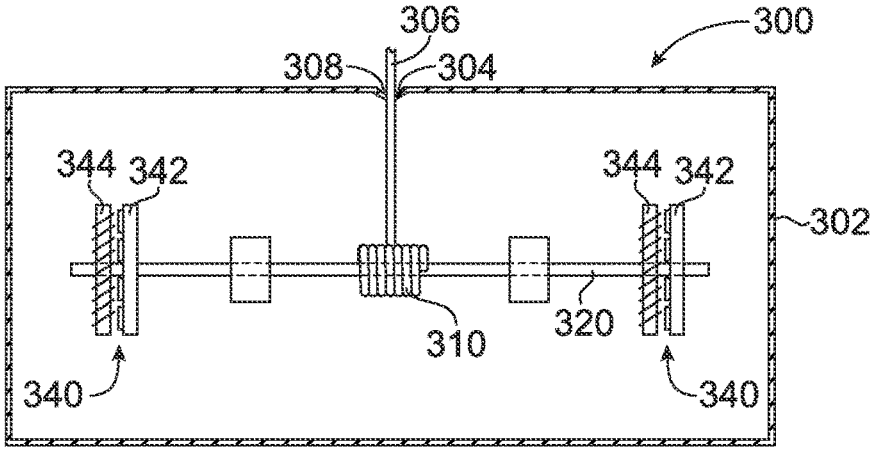
FIG. 19 is a top cross-sectional view of yet another retraction device in accordance with an embodiment.

Referring now to FIGS. 17-19, a retraction device 300 includes a housing 302 having an opening 304. An extendable and retractable cable 306 extends through the opening 304 and is moveable between a retracted position and an extended position, as described above. The opening 304 is circumscribed by a rounded flange 308 that enables the cable 306 to extend from the opening 304 in any direction. In some embodiments, the flange 308 is a ring that is secured to the opening 304. In other embodiments, the flange 308 is molded onto the housing 302. For example, in some embodiments, one side of the housing 302 includes the flange 308, and the other side of the housing 302 includes an indentation to receive the flange 308 so that the flange 308 is formed from a single integral piece.

Inside the housing 302, a fixed end 310 of the cable 306 is coupled to an axle 320. In the embodiment shown in FIG. 17, the fixed end 310 of the cable 306 is wound around a spool 322 that rotates with the axle 320. In the embodiment shown in FIGS. 18-19, the fixed end 310 of the cable 306 is wound directly around the axle 320. At least one resistance device 330 is coupled to the axle 320 to bias the cable 306 into the retracted position. The at least one resistance device 330 is a spring, a magnet, or a motor, in some embodiments. A tensioning device 332, for example, any of the tensioning devices described herein, adds tension to the axle 320 to restrict movement of the cable 306.

In the embodiment shown in FIG. 19, the retraction device 300 includes at least one power generator 340. The at least one power generator 340 includes a magnet disk 342 that rotates relative to a coil disk 344, having a coil of wire, when the cable 306 is moved between the extended and retracted positions. For example, in one embodiment, the magnet disk 342 is stationary and the coil disk 344 rotates with the axle 320 when the cable 306 is moved between the extended and retracted positions. In another embodiment, the coil disk 344 is stationary and the magnet disk 342 rotates with the axle 320 when the cable 306 is moved between the extended and retracted positions. In either embodiment, the disk rotating with the axle 320 continues to freely rotate after movement of the cable 306. The power generator 340 generates an electric current that is stored or otherwise used, as described herein.

Figure 20:
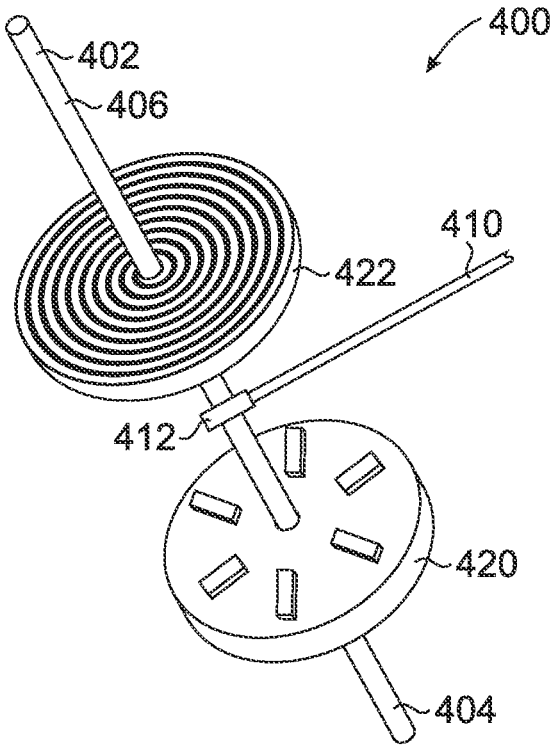
FIG. 20 is a perspective view of a power generator in accordance with an embodiment.

Referring to FIG. 20, a power generator 400 is usable with any of the retraction device embodiments described herein. The power generator 400 includes a dual axle 402 having a first axle 404 that rotates freely of a second axle 406. An extendable and retractable cable 410 is coupled to one of the first axle 404 or the second axle 406 by a clutch 412. A magnet disk 420 is configured to rotate with the first axle 404. A coil disk 422 is configured to rotate with the second axle 406. When the cable 410 is moved to the extended position, the clutch 412 connects the cable 410 to the first axle 404 to rotate the magnet disk 420 in a first rotational direction. As the cable 410 begins retracting back to the retracted position, the clutch 412 connects the cable 410 to the second axle 406 to rotate the coil disk 422 is a second rotational direction opposite the first rotational direction. At any time, the clutch is releasable from both the first axle 404 and the second axle 406 so that the magnet disk 420 and the coil disk 422 rotate freely. The power generator 400 generates an electric current that is stored or otherwise used, as described herein.

Figure 21:
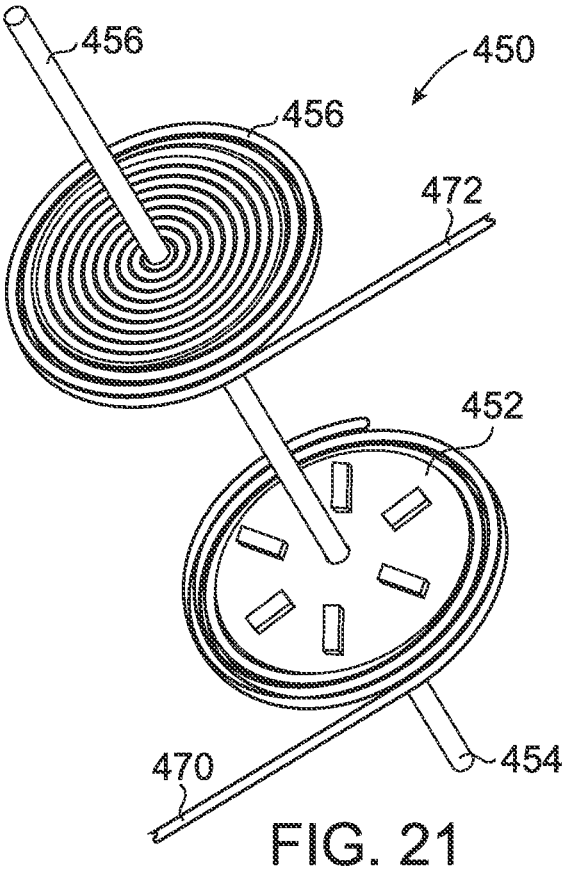
FIG. 21 is a perspective view of another power generator in accordance with an embodiment.

FIG. 21 illustrates another embodiment of a power generator 450 including a magnet disk 452 coupled to a first axle 454 and a coil disk 456 couple to a second axle 458. A first extendable and retractable cable 470 is coupled to the magnet disk 452, and a second extendable and retractable cable 472 is coupled to the coil disk 456. By pulling the first cable 470 and the second cable 472 in different directions, the magnet disk 452 rotates in a rotational direction that is opposite rotation of the coil disk 456. In some embodiments, the magnet disk 452 and the coil disk 456 continue to rotate after movement of the first cable 470 and the second cable 472. The power generator 450 generates an electric current that is stored or otherwise used, as described herein.

In the embodiments of FIGS. 19-21, movement of the cable between the retracted position and the extended position causes at least one of the magnet disk and the coil disk to move relative to the other of the magnet disk and the coil disk to generate the electric current. In some embodiments, the magnet disk rotates relative to the coil disk. In some embodiments, the coil disk rotates relative to the magnet disk. In some embodiments, both the magnet disk and the coil disk rotate. In some embodiments, the magnet disk and the coil disk rotate in opposite rotational directions, for example clockwise and counter-clockwise. In some embodiments, a magnet is coupled to the axle so that the magnet rotates when the cable moves between the retracted position and the extended position. In some embodiments, the coil of wire is coupled to the housing and positioned around the magnet. In some embodiments, the coil of wire is coupled to the axle so that the coil of wire rotates when the cable moves between the retracted position and the extended position. In some embodiments, the magnet is coupled to the housing and positioned around the coil of wire. In some embodiments, the coil rotates in a first axial direction on a first axle, and the magnet rotates in a second axial direction opposite the first direction on a second axle. It will be appreciated, that in some embodiments, the magnet is coupled to the first axle, and the coil is coupled to the second axle.

In the embodiment of FIG. 21, the first cable coupled to a first resistance device, and movement of the first cable between the retracted position and the extended position causes the magnet to move relative to the coil. The second cable is coupled to a second resistance device, and movement of the second cable between the retracted positioned and the extended position causes the coil to move relative to the magnet. It will be appreciated that, in some embodiments, movement of the first cable causes the coil to move relative to the magnet, and movement of the second cable cause the magnet to move relative to the coil. In some embodiments, the magnet moves in a first direction and the coil moves in a second direction that is opposite the first direction.

In some of the embodiments of FIGS. 19-21, each cable has a length that is greater than a reach of a user. For example, in some embodiments, the cable is at least 31 inches in length. In other embodiments, the cable is greater than 31 inches in length. In some embodiments, the device is an exercise device. In some embodiments, the electric current is stored in a battery, for example a rechargeable battery that is configured to electrically couple to the housing to store the electric current. In some embodiments, the electric current powers a facility housing the exercise device, for example an exercise or health facility. For example, an electrical connection between the housing and an electrical supply of the health facility transmits the electric current to the electrical supply of the facility. Accordingly, the device is scaleable to larger sizes and configured to attach to any surface/structure/frame for use in larger workout equipment. Such a configuration facilitates reducing the cost and weight of exercise machines in a health facility, while providing power to the machine, for example through battery storage. In some embodiments, a weight stack is replaced with the variable resistance devices described herein.

Figure 22:
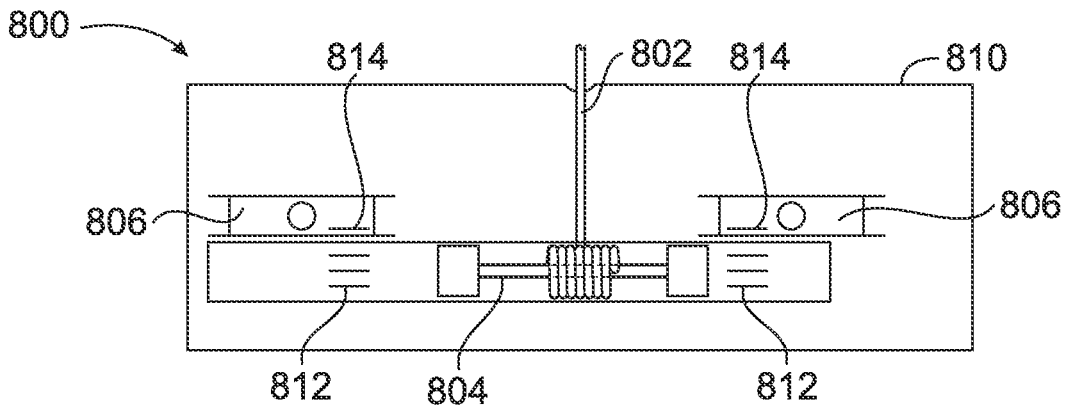
FIG. 22 is a top cross-sectional view of a retraction device in accordance with an embodiment.
Figure 23:
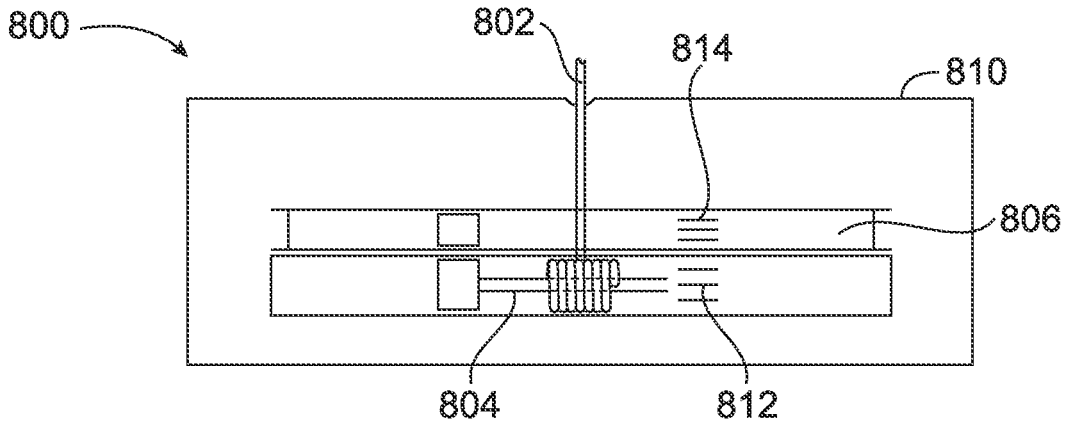
FIG. 23 is a top cross-sectional view of another retraction device in accordance with an embodiment.

Referring now to FIGS. 22 and 23, a retraction device 800 includes an extendable and retractable cable 802 wound around an axle 804. At least one tensioning mechanism 806. For example, FIG. 22 includes a pair of tensioning mechanisms 806, and FIG. 23 includes a single tensioning mechanism 806. The tensioning mechanism 806 extends lengthwise substantially parallel to the axle 804 to compactly arrange the components of the retraction device 800 in a housing 810. A gear 812 on the axle 804 cooperates with a gear 814 on the tensioning mechanism 806 so that the tensioning mechanism 806 provides a desired tension to the axle 804, and thus, the cable 802. In some embodiments, the tensioning mechanism 806 is any of the tensioning mechanisms described herein.

Figure 24:
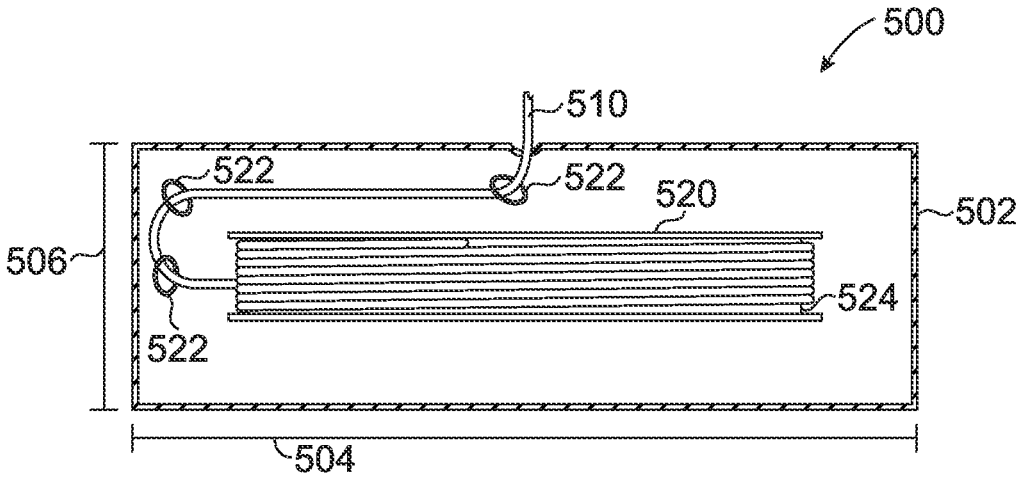
FIG. 24 is a top cross-sectional view of yet another retraction device in accordance with an embodiment.

Referring to FIG. 24, a retraction device 500 includes a housing 502 having a width 504 and depth 506. An extendable and retractable cable 510 extends from and retracts into the housing 502. A spool 520 extends along the width 504 of the housing 502 to save space with respect to the depth 506 of the housing 502. The cable 510 extends from the housing 502 is a direction substantially perpendicular to the spool 520. A plurality of guide rings 522 alter a direction of the cable 510 through the housing 502 so that a fixed end 524 of the cable 510 winds around the spool 520. In some embodiments, the guide rings 522 are replaced with pulleys.

Figure 25:
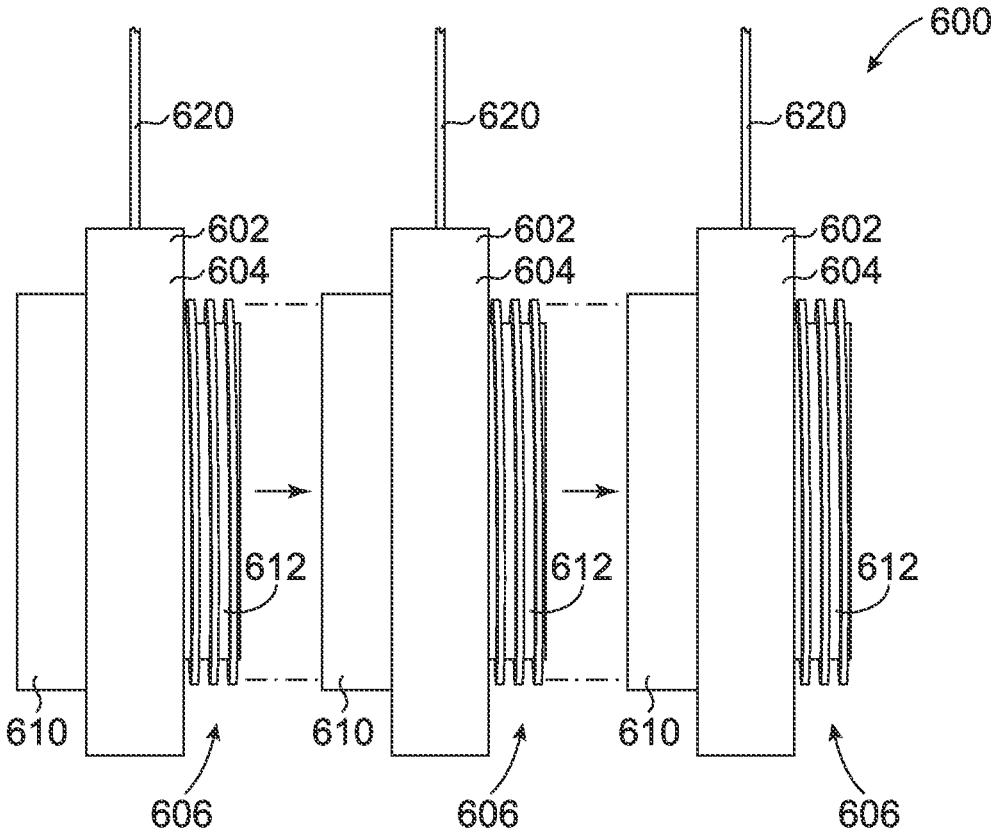
FIG. 25 is a top view of an exercise kit in accordance with an embodiment.

Referring now to FIG. 25, an exercise kit 600 includes a plurality of retraction devices 602. The retraction devices 602 include any of the retraction devices described herein. Each retraction device 602 includes a housing 604. A fastening device 606 is formed on the housing 604 of each retraction device 602. In some embodiments, the fastening device 606 includes any suitable device for coupling the retraction devices together. In the illustrated embodiment, the fastening device 606 includes a female threaded end 610 and a male threaded end 612. The male threaded end 612 of one retraction device 602 is configured to be received in the female threaded end 610 of another retraction device 602.

The cable 620 of each retraction device 602 is tensioned to a predetermined tension. In some embodiments, each retraction device 602 has the same degree of tension. In some embodiments, each retraction device 602 has a different degree of tension. Any number of retraction devices 602 are couplable together to increase a degree of tension by attaching multiple cables to an interchangeable exercise component, as described herein.

Figure 31:
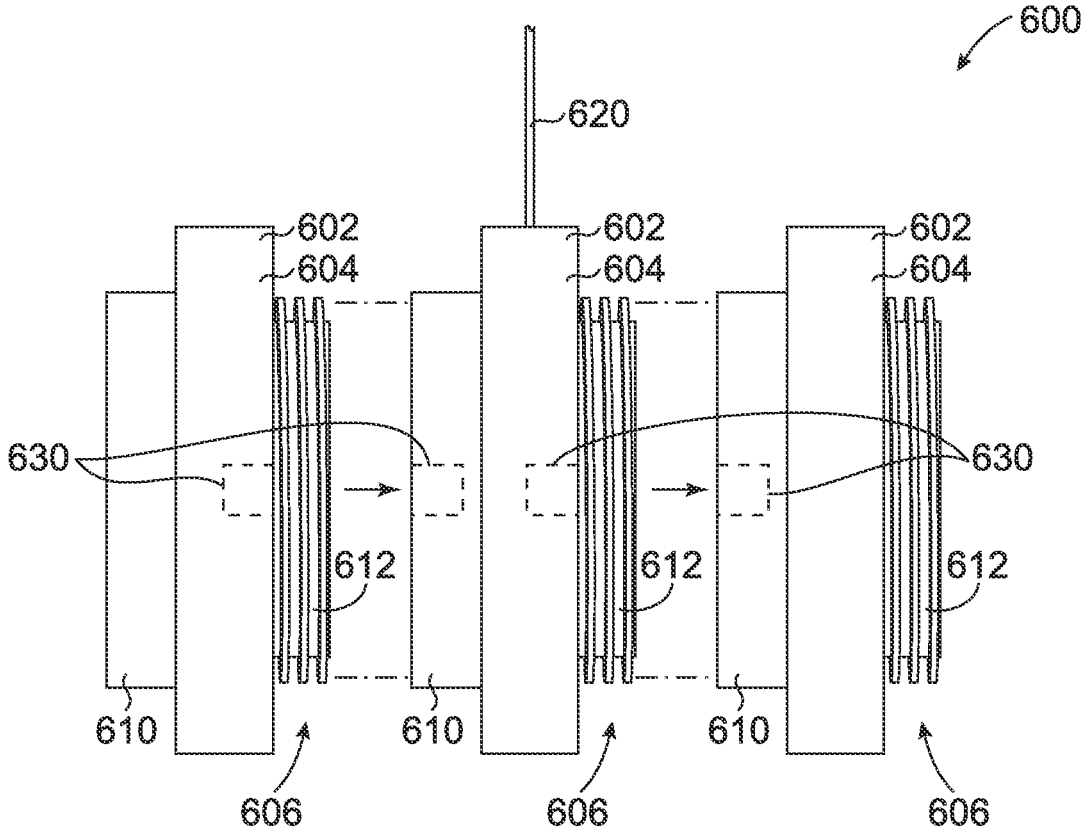
FIG. 31 is a top view of another exercise kit in accordance with an embodiment.

In the embodiment shown in FIG. 31, only one of the retraction devices 602 includes cable 620. In such an embodiment, each retraction device 602 includes a resistance mechanism 630. The resistance mechanisms couple together when the fastening devices 606 are coupled to increase the resistance on the cable 620. Each retraction device 602 has a different resistance to alter the resistance on the cable 620 by selectively adding retraction devices 602 to the device 602 having the cable 620.

Figure 26:
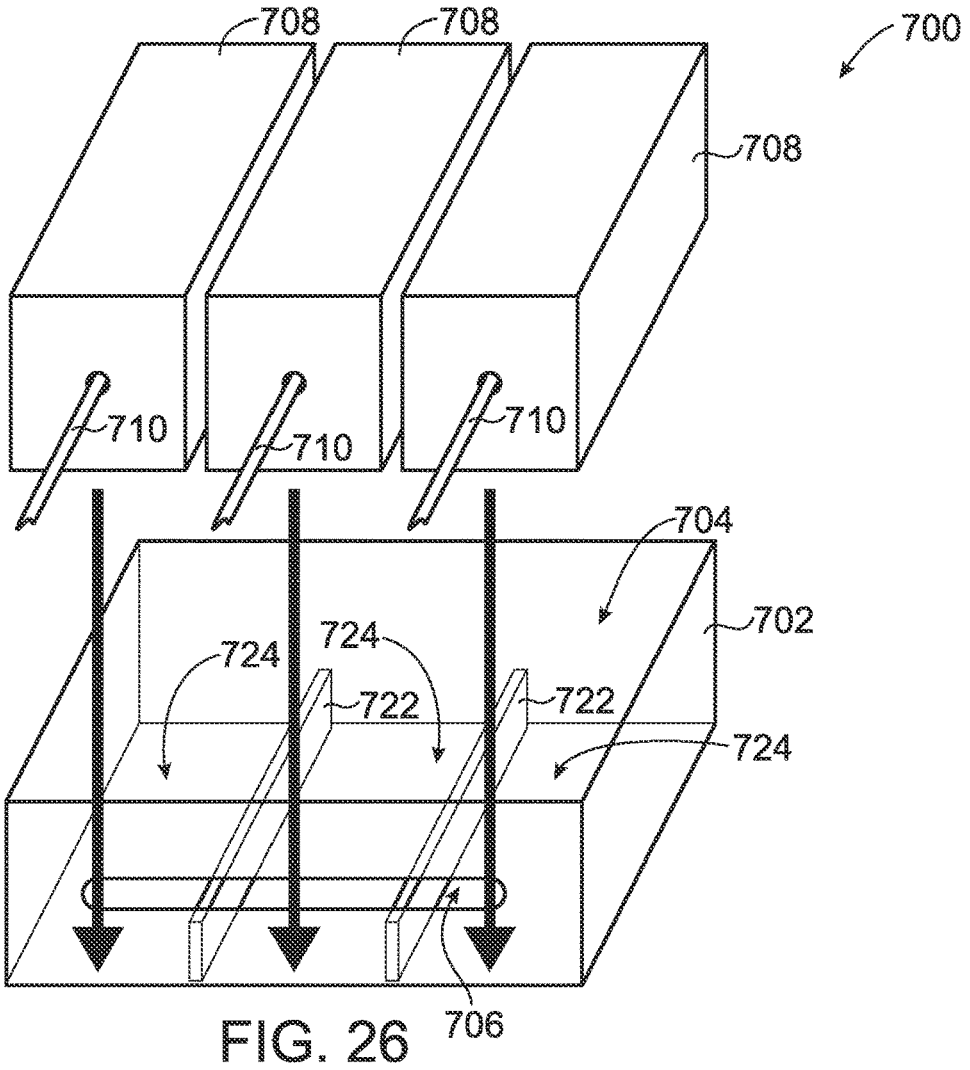
FIG. 26 is a top view of another exercise kit in accordance with an embodiment.
Figure 27:
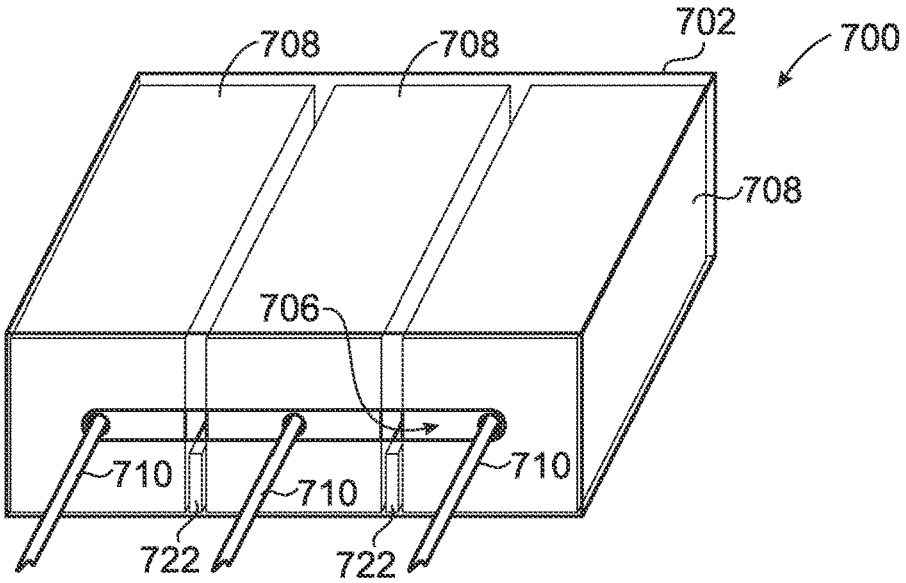
FIG. 27 is a top view of yet another exercise kit in accordance with an embodiment.

FIGS. 26 and 27 illustrate another exercise kit 700 including casing 702 that defines a cavity 704. An opening 706 extends through the casing 702 from the cavity 704. A plurality of retraction devices 708 are configured to be positioned in the cavity 704 so that a cable 710 of each retraction device 708 extends through the opening 706. In some embodiments, each retraction device 708 has the same degree of tension. In some embodiments, each retraction device 708 has a different degree of tension. Any number of retraction devices 708 are positionable in the cavity 704 of the casing 702, as illustrated in FIG. 27, to increase a degree of tension by attaching multiple cables to an interchangeable exercise component, as described herein.

In the illustrated embodiment, a bottom 720 of the cavity 704 includes guides 722 that form slots 724 for receiving the individual retraction devices 708. In some embodiments, the sidewalls of the cavity 704 include guides for defining the slots 724. It will be appreciated that the individual retraction devices 708 are couplable within the cavity 704 using any suitable fastening mechanism.

The cable of each of the plurality of individual retraction devices or exercise devices is tensioned to restrict movement of the cable between the retracted position and the extended position, in some embodiments. In some embodiments, each of the plurality of individual retraction devices includes a tensioning mechanism to tension the respective cable. The tensioning mechanism is adjustable to alter the tension on the respective cable. In some embodiments, each cable of each of the plurality of individual retraction devices has a different degree of tension. Any combination of the plurality of individual retraction devices is positionable in the cavity of the casing. The cable of each of the plurality of individual retraction devices extends from the casing when the exercise device is positioned in the cavity of the casing, and an end of each cable extending from the casing is coupleable to an interchangeable exercise component. In some embodiment, the interchangeable exercise component includes at least one of a bar, a loop, a cuff or any exercise component described herein.

Referring to the embodiments of FIGS. 25-27, each of the cables independently moves between the extended position and the retracted position. In some embodiments, each of the cables have a length that is greater than a reach of a user. In some embodiments, a first cable and a second cable are configured to be secured to separate limbs of the user so that the first cable and the second cable are moved through the movement of each respective limb. In some embodiments, each of the first cable and the second cable are configured to secure to the same limb of a user to increase a resistance of the device. A resistance of each cable is configured to be independently altered, in some embodiments. In some embodiments, a first cable is configured to move in a first direction, and a second cable is configured to move in a second direction, wherein the first direction is independent of the second direction.

Figure 28:
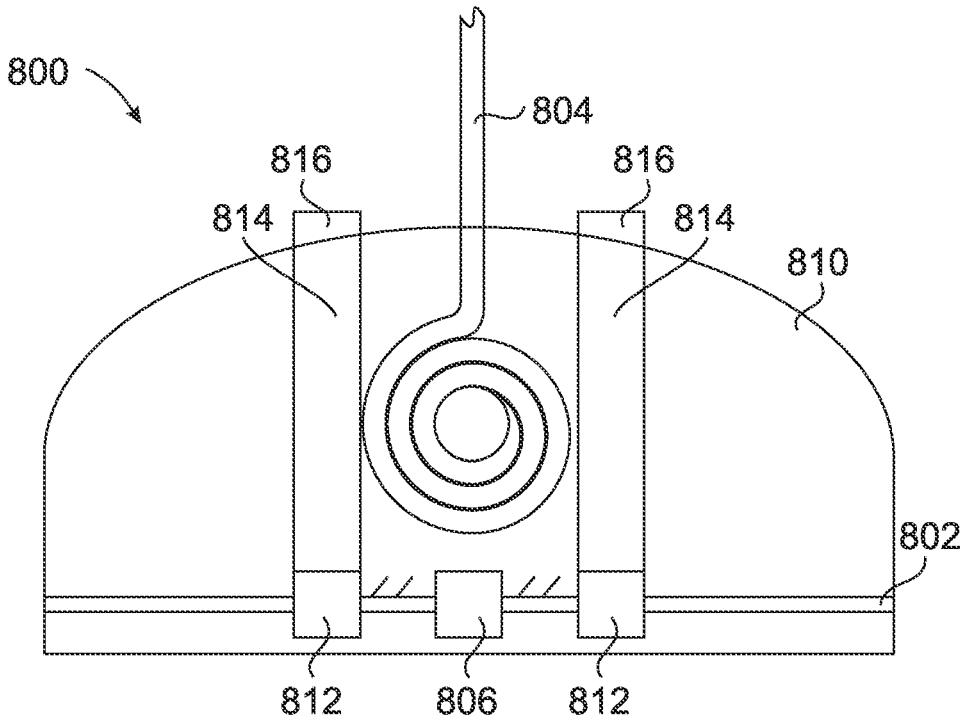
FIG. 28 illustrates a gear system to attach to one of plurality of resistance spools to an axle to restrict movement of the cable.

Referring now to FIG. 28, a retraction device 800 includes an axle 802 that couples to a cable 804 via a gear 806 to retract the cable 804 into a housing 810. The axle 802 includes at least one resistance gear 812. A resistance device 814 is configured to engage each resistance gear 812. In the illustrated embodiment, the resistance device 814 is slid into contact with the respective resistance gear 812 by actuating a slider 816. Each resistance device 814 has a predetermined resistance. For example, the axle 802 has a one pound resistance, in some embodiments, and one of the resistance devices 814 has a two pound resistance, while the other resistance device 814 has a three pound resistance. The resistance on the cable 804 is adjusted by engaging combinations of resistance devices 814. The retraction device 800 includes any number of resistance devices 814, wherein each resistance device 814 has any predetermined resistance, in some embodiments.

In some embodiments, each housing includes a control system, and the control system of at least one housing tracks data related to movement of the first cable and the second cable, as described herein. The control systems of each housing wirelessly communicate, in some embodiments. For example, the plurality of devices includes a master device and at least one slave device. In some embodiments, the master device stores the data tracked by the master device and the at least one slave device. In some embodiments, at least one of the plurality of devices includes a power generation device to generate an electric current when the respective cable moves between the retracted and extended position.

In some embodiments, the control circuitry described herein controls all aspects of the cable, for example, a resistance level which can be set or part of a variable level of resistance workout, speed of movement of the cable during extension and retraction, and length of extension and retraction. In some embodiments, the control circuitry controls and tracks the use of the device. For example, the resistance level, in some embodiments, is set via the app. In such an embodiment, the app includes multiple resistance levels to apply during the particular workout to simulate heavier lift, hills (for an ankle cuffs retractor device) and the like. The ability of the processor to control the cable is usable, in some embodiments, on hardwired larger units in health facilities. The power from the hardwired unit, in some embodiments, controls the processor and the unit for resistance, etc. In some embodiments, the control system moves parts for tension and resistance, for example, moving resistance plates, moving magnets closer for drag, putting resistance on a motor device, tightening a spring, etc.

Figure 32:
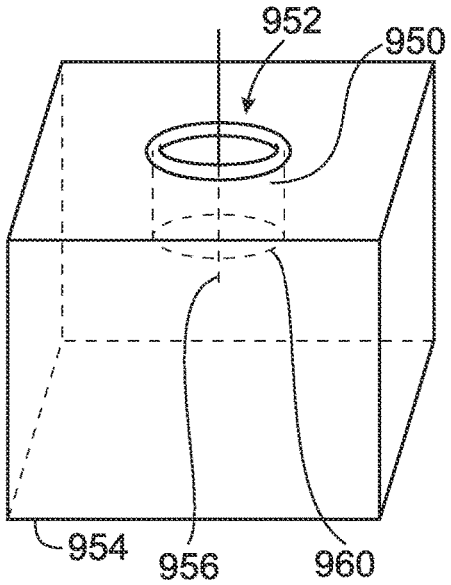
FIG. 32 is a cross-sectional view of a protective component in accordance with an embodiment.
Figure 33:
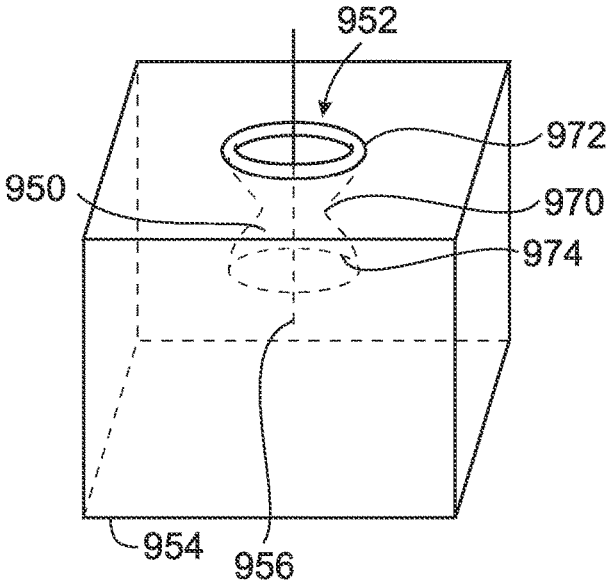
FIG. 33 is a cross-sectional view of another protective component in accordance with an embodiment.
Figure 34:
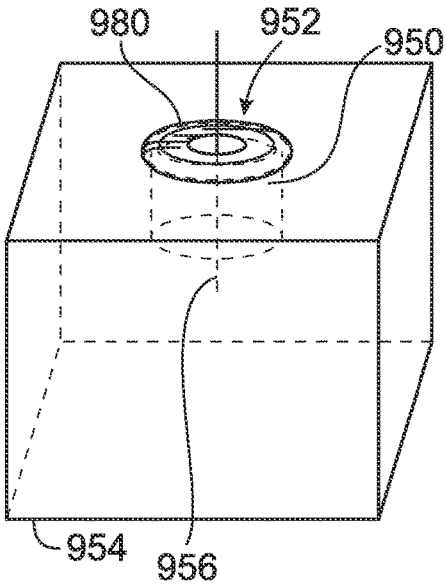
FIG. 34 is a cross-sectional view of yet another protective component in accordance with an embodiment.

FIGS. 32-34 illustrate cross-sectional views of protective components 950 that are configured to position in an opening 952 of a housing 954 through which a cable 956 extends. It will be appreciated that the protective components 950 can be used with the housing of any of the retraction devices described herein. The protective components 950 fit firmly in the opening 952, in some embodiments. In other embodiments, the protective components 950 fit loosely in the opening 952 and move or rotate relative to the opening 952 as the cable 956 moves through the opening 952. The protective components 950 are configured to protect both the housing 954 and the cable 956 from wear and tear as the cable 956 moves through the opening 952.

In some embodiments, the protective components 950 are formed from a low friction and/or substantially frictionless material. For example, the protective components 950 are formed from stainless steel, in some embodiments. In some embodiments, the protective components are formed from a rubber material. In some embodiments, the protective components 950 are polished to reduce friction. In some embodiments, the protective components 950 are configured to guide the cable 956 through the opening 952. In some embodiments, the protective components 950 are replaceable.

FIG. 32 illustrates a protective component 960 that is formed as a tube. In some embodiments, the tube is shortened to a ring positioned in the opening 952. In other embodiments, the tube is elongated and extends into the housing 954. The protective component 960 is cylindrical, in some embodiments. In other embodiments, the protective component 960 has any suitable shape. FIG. 33 illustrates a protective component 970 that is tapered toward the center and flares outward on the ends. The flared end 972 adjacent the opening 952 is configured to guide a direction of the cable 956 as the cable 956 extends outward from the housing 954. The other flared end 974 guides the cable 956 on to the spool or axle as the cable 956 retracts into the housing 954. FIG. 34 illustrates a protective cover 980 that positions around either the opening 952 or an end of the protective component 950. The cover 980 is formed from a resilient material, for example, rubber. In some embodiments, the cover 980 is replaceable.

Figure 35:
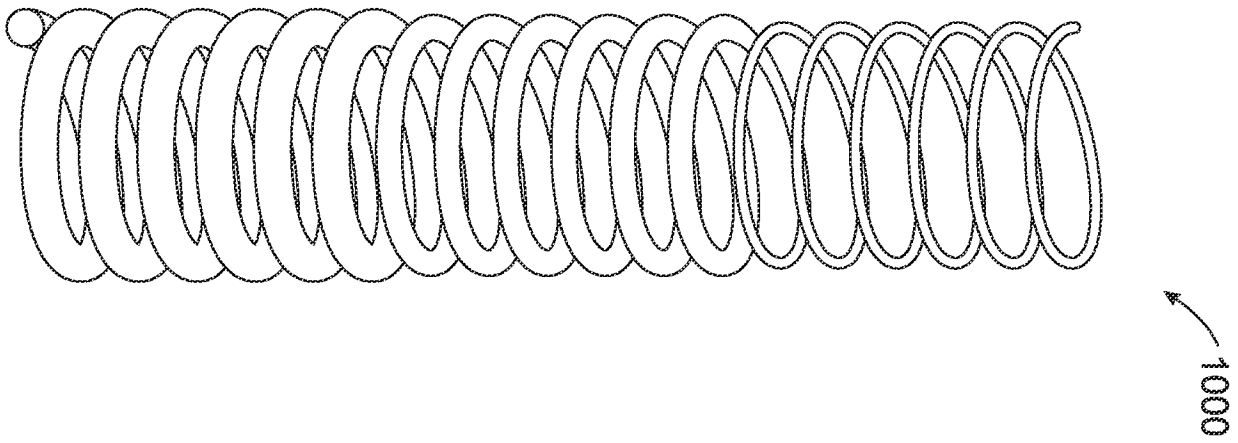
FIG. 35 is a front view of a tensioning mechanism formed in accordance with an embodiment.
Figure 36:
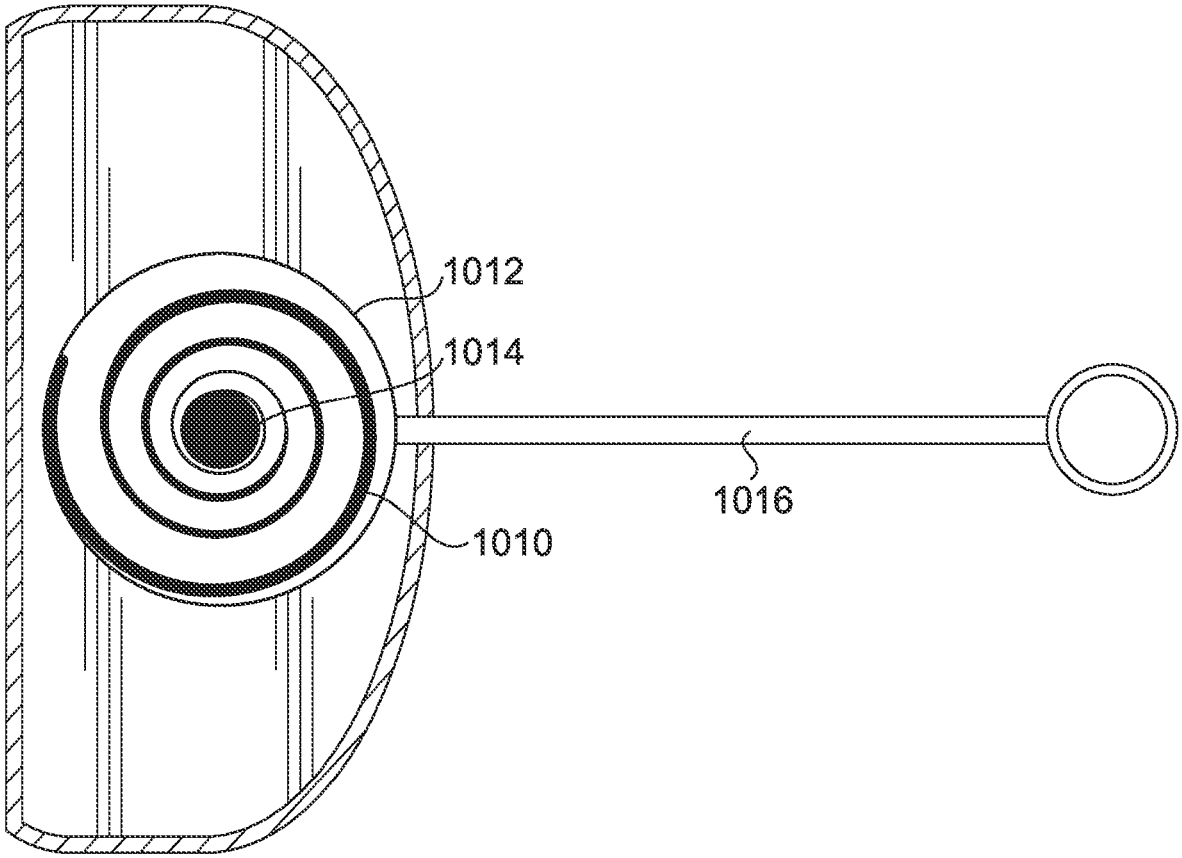
FIG. 36 is a front view of another tensioning mechanism formed in accordance with an embodiment.

Referring now to FIGS. 35-36, tensioning mechanisms 1000 and 1010 are embodied as springs. The tensioning mechanisms 1000 and 1010 can be used in place of any of the tensioning mechanisms described herein. Additionally, the tensioning mechanisms 1000 and 1010 can be used in any of the retraction devices described herein. In the illustrated embodiments, the tensioning mechanisms 1000 and 1010 have three different widths or thicknesses. The tensioning mechanisms 1000 and 1010 are capable of being tightened on a respective spool or axle, for example with a screw, a lever, a button, a knob, or the like so that the tensioning mechanisms inherent resistance is increased. For example, in FIG. 36, the tensioning mechanism 1010 is coupled to an axle 1014 and a spool 1012 and can be turned to compress the spring to increase the resistance and restrict movement of a cable 1016. As the tensioning mechanisms 1000 and 1010 get wider and/or thicker when tightened, the resistance on the spool/axle increases. The least resistance portion of the tensioning mechanisms 1000 and 1010 is when the tensioning mechanisms 1000 and 1010 are in their zero setting mode. Turning an actuator compresses the tensioning mechanisms 1000 and 1010 to increase tension. The tension is further increased when the tightening reaches the wider or thicker or both portion of the tensioning mechanisms 1000 and 1010. Maximum tension still permits the cable to extend to needed length, but with more resistance. In some embodiments, the tensioning mechanisms 1000 and 1010 provide another mechanism to increase the resistance in addition to a friction device, a magnet, a motor, or other embodiments described herein. In some embodiments, the tensioning mechanisms 1000 and 1010 are not limited to a fixed number of sections or thicknesses or shapes. For example, the tensioning mechanisms 1000 and 1010, in some embodiments, have one or more than one thickness, width, or shape. In another embodiment, the tensioning mechanisms 1000 and 1010 have a single thickness and multiple widths, or multiple thicknesses and a single with, or a combination thereof. In some embodiments, the tensioning mechanisms 1000 and 1010 include a single/solid spring unit or multiple springs layered. In some embodiments, the tensioning mechanisms 1000 and 1010 include a catch system that enables the tightening to be held in place, and can be loosened as well.

It will be appreciated that any of the retraction devices described herein are scalable for use in exercise equipment in a fitness facility, rehab facility, home gym, or the like. For example, any of the retraction devices described herein are scalable for use with strength training machines, exercise machines, workout machines, or the like. The machine and/or the retraction device communicates with a user's mobile device, in some embodiments, to track the user's workout, provide exercise guidance, or instruct the user. In some embodiments, data tracked by the control system is reported to another party, for example, a doctor, a trainer, a physical therapist, or the like.

All permutations and variations of features described above in each embodiment are intended to be applicable to each of the other embodiments, such that features may be mixed and matched to create additional embodiments in accordance with this disclosure. For example, any embodiment of the retraction devices 10, 300, 500, and 800 may include the control circuitry 70. Any embodiment of the retraction devices 10, 300, 500, and 800 may include any one of the embodiments of the attachment mechanisms 60. Any embodiment of the retraction devices 10, 300, 500, and 800 may include any one of the embodiments of the resistance device 80. Any embodiment of the retraction devices 10, 300, 500, and 800 may include any one of the embodiments of the tensioning mechanisms 130, 200, 850, and 900. Any embodiment of the retraction devices 10, 300, 500, and 800 may include the dial 140 or an equivalent slide mechanism. Any embodiment of the retraction devices 10, 300, 500, and 800 may include any of the embodiments of the power generators 400 and 450. Any embodiment of the kit 600 may include the control circuitry 70. Any embodiment of the kit 600 may include any embodiment of the attachment mechanisms 60. Any embodiment of the kit 600 may include any embodiment of the resistance device 80. Any embodiment of the kit 600 may include any embodiment of the tensioning mechanisms 130, 200, 850, and 900. Any embodiment of the kit 600 may include the dial 140 or equivalent slide mechanism. Any embodiment of the kit 600 may include any embodiment of the power generator 400 and 450.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless cannot be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used, the item can include a portion and/or the entire item unless specifically stated to the contrary. It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles have been presented, they need not be utilized in combination, and many combinations of aspects and principles are possible in light of the various embodiments provided above.

What is claimed is:

1. An exercise kit, comprising a plurality of devices, wherein each device comprises:

a cable configured to extend from a housing between a retracted position and an extended position, wherein the cable of each of the plurality of devices is configured to individually and simultaneously attach to a different limb of a user and move through the movement of the respective limb, a resistance device positioned in the housing and configured to bias the cable into the retracted position, and a control system to track data related to movement of the cable, wherein the control systems of each device communicate wirelessly, and wherein the wherein the kit further comprises a master device that stores the data tracked by each control system.

2. The device of claim 1, wherein each devices comprises a housing configured to couple to a fixed location to anchor the device.

3. The device of claim 2, wherein each housing is configured to secure to a user.

4. The device of claim 2, wherein the resistance device of each device is positioned in a respective housing and the respective cable extends from and retracts into the respective housing.

5. The device of claim 2, wherein the housings of each device are configured to couple to one another.

6. The device of claim 2, wherein the housing of at least device includes a power generation device to generate an electric current when the respective cable moves between the retracted and extended position.

7. The device of claim 1, wherein the cable of each device has a length that is greater than a reach of a user.

8. The device of claim 1, wherein a resistance of the first cable of each device is configured to be independently altered.

9. The device of claim 1, wherein:

a cable of a first device of the plurality of devices is configured to move in a first direction, and a cable of a second device of the plurality of devices is configured to move in a second direction, wherein the first direction is independent of the second direction.

10. The device of claim 1, wherein movement of the cable of at least one of the devices generates an electric current.

* * * * *